US008181721B1

(12) United States Patent
Keast

(10) Patent No.: US 8,181,721 B1
(45) Date of Patent: May 22, 2012

(54) TORQUE TRACK AND SLIDE ASSEMBLY

(76) Inventor: Larry G. Keast, Houston, TX (US)

( * ) Notice: Subject to any disclaimer, the term of this patent is extended or adjusted under 35 U.S.C. 154(b) by 0 days.

(21) Appl. No.: 13/099,149

(22) Filed: May 2, 2011

Related U.S. Application Data

(63) Continuation-in-part of application No. 12/861,518, filed on Aug. 23, 2010, now Pat. No. 7,984,757.

(60) Provisional application No. 61/376,095, filed on Aug. 23, 2010, provisional application No. 61/420,672, filed on Dec. 7, 2010.

(51) Int. Cl.
*E21B 3/00* (2006.01)

(52) U.S. Cl. ..... 175/195; 175/162; 175/170; 175/203

(58) Field of Classification Search ..... 175/162, 175/170, 195, 203, 103
See application file for complete search history.

(56) References Cited

U.S. PATENT DOCUMENTS

| | | | | |
|---|---|---|---|---|
| 2,420,363 | A * | 5/1947 | Espenas | 403/43 |
| 3,838,613 | A | 10/1974 | Wilms | |
| 4,421,179 | A | 12/1983 | Boyadjieff | |
| 5,038,871 | A * | 8/1991 | Dinsdale | 175/52 |
| 5,433,279 | A * | 7/1995 | Tessari et al. | 173/213 |
| 5,501,286 | A * | 3/1996 | Berry | 175/52 |
| 6,951,082 | B2 * | 10/2005 | Nelson et al. | 52/112 |
| 7,231,969 | B2 * | 6/2007 | Folk et al. | 166/77.51 |
| 7,320,374 | B2 * | 1/2008 | Folk et al. | 175/220 |
| 7,584,810 | B1 * | 9/2009 | McKnight et al. | 175/162 |
| 7,637,329 | B2 * | 12/2009 | Stoik | 175/57 |
| 7,921,939 | B1 * | 4/2011 | Keast et al. | 175/113 |
| 7,984,757 | B1 * | 7/2011 | Keast et al. | 166/77.1 |
| 8,127,836 | B1 * | 3/2012 | Keast et al. | 166/77.1 |
| 2008/0099208 | A1 * | 5/2008 | Moncus et al. | 166/338 |
| 2008/0210416 | A1 * | 9/2008 | Lesko | 166/85.5 |

* cited by examiner

*Primary Examiner* — William P Neuder
*Assistant Examiner* — Elizabeth Gottlieb
(74) *Attorney, Agent, or Firm* — Buskop Law Group, PC; Wendy Buskop

(57) ABSTRACT

A top drive track and slide assembly for use in drilling wells having a torque track slide assembly configured to connect to a top drive, and a modular torque track assembly configured to engage the torque track slide assembly. The modular torque track assembly can connect on a drilling rig. The modular torque track assembly can have a top track, one or more middle tracks, and a bottom track. One of the middle tracks can connect to the top track, and one of the middle tracks can connect to the bottom track using locking devices and connecting pins. The modular torque track assembly can be configured to be various lengths for various applications. The torque track slide assembly can have inserts retained therein without fasteners, allowing the inserts to be completely worn down before requiring replacement.

11 Claims, 18 Drawing Sheets

TORQUE TRACK AND SLIDE ASSEMBLY

CROSS REFERENCE TO RELATED APPLICATIONS

The present application claims priority to and the benefit of, as a continuation in part, U.S. Provisional Patent Application Ser. No. 61/376,095, filed on Aug. 23, 2010, entitled "TOP DRIVE WITH AN AIRLIFT THREAD COMPENSATOR AND A HOLLOW CYLINDER ROD PROVIDING MINIMUM FLEXING OF CONDUIT"; co-pending U.S. patent application Ser. No. 12/861,518, filed on Aug. 23, 2010, entitled "DRILLING RIG WITH A TOP DRIVE WITH AN AIRLIFT THREAD COMPENSATOR AND A HOLLOW CYLINDER ROD PROVIDING MINIMUM FLEXING OF CONDUIT"; and U.S. Provisional Patent Application Ser. No. 61/420,672, filed on Dec. 7, 2010, entitled "TORQUE MEASURING TOP DRIVE". These references are hereby incorporated in their entirety herein.

FIELD

The present embodiments generally relate to a top drive torque track and slide assembly, including a modular torque track assembly and a torque track slide assembly having inserts engaged therein without fasteners.

BACKGROUND

A need exists for a modular torque track assembly that can be configured to have various different lengths, allowing the modular torque track assembly to be adapted for different applications.

A need exists for a modular torque track assembly that provides a stronger engagement between adjacent portions of the modular torque track assembly when compared to torque tracks that are connected using bolts and flanges.

A need exists for a torque track slide assembly that has inserts that are engaged therein without fasteners, allowing the inserts to be completely worn down without risking engagement between the modular torque track assembly and the fasteners.

A need exists for a torque track slide assembly that can be easily assembled.

The present embodiments meet these needs.

BRIEF DESCRIPTION OF THE DRAWINGS

The detailed description will be better understood in conjunction with the accompanying drawings as follows.

Figure 1:
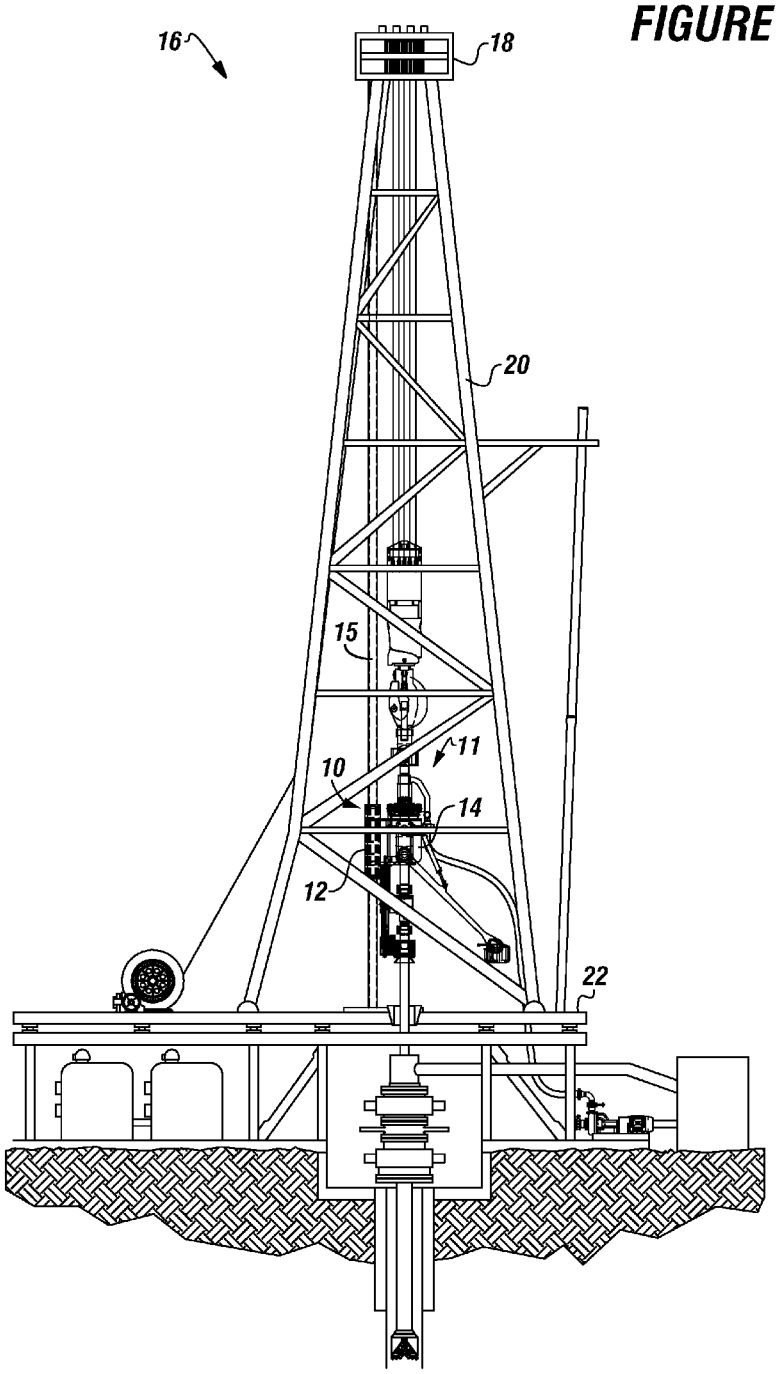
FIG. 1 is a side view of a drilling rig with an installed top drive track and slide assembly.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that the embodiments can be practiced or carried out in various ways.

The present embodiments relate to a top drive track and slide assembly for use in drilling wells.

The top drive track and slide assembly can include a modular torque track assembly that can be configured to have various different lengths, allowing the modular torque track assembly to be adapted for different applications.

The modular torque track assembly can include connecting pins and locking devices, which can provide a stronger engagement between adjacent portions of the modular torque track when compared to torque tracks that are connected using bolts and flanges.

The top drive track and slide assembly can include a torque track slide assembly with inserts that are engaged therein without fasteners.

One or more of the inserts can be retained within a slide body of the torque track slide assembly by corner ridges, allowing the inserts to be completely worn down without risking engagement between the modular torque track and fasteners.

Other inserts can have fastener recesses, and can be retained within the slide body with insert fasteners. The insert fasteners can extend within the fastener recesses without extending past the fastener recesses. Therefore, the inserts attached with the insert fasteners can be fully worn down without the insert fasteners engaging the modular torque track assembly, and the inserts retained by the corner ridges can also be fully worn down as they are retained without fasteners.

For example, during use of the top drive track and slide assembly, as the torque track slide assembly slides along the modular torque track assembly, the inserts gradually wear down. If fasteners are used to attach the inserts, the modular torque track assembly can engage the fasteners before the inserts are fully worn down, which would require the inserts to be replaced before the modular torque track assembly engages the fasteners, and therefore before the inserts are fully worn down.

As such, one or more of the present embodiments avoid the requirement for early replacement of inserts, and allows for the inserts to be completely worn down before replacement.

Furthermore, the inserts can each have a plurality of tabs disposed along one or more edges of the inserts. The tabs can be arranged and configured along the inserts, such that the inserts will only fit within the slide body in a single way, therefore a user can easily assemble the inserts within the torque track slide assembly without the risk of error.

The top drive track and slide assembly can be used on various top drives known to those skilled in the art. Top drives, such as for use in oilfields, are power swivels in combination with certain additional features that facilitate torque reaction and pipe handling.

A power swivel is a hydraulic or electric powered rotating device that is suspended in or on a derrick, and that drives a drill pipe from above a rig floor. The top drive can replace the rotary table, which drives the pipe from lower down, at the rig floor level.

The power swivel can generate torque that is reacted by vertical torque track members in the derrick on which the power swivel moves upwards and downwards. That is, the torque track can be arranged such that the swivel torque is restrained regardless of where the power swivel is vertically positioned in the derrick. Typical top drives on the market can transmit power swivel torque to the torque tracks, imparting torque and at least some side loads to the derrick.

One or more embodiments relate to a top drive track and slide assembly for use in drilling wells, such as gas wells, oil wells, or other wells.

The top drive track and slide assembly can include a torque track slide assembly configured to connect to a top drive housing of a top drive.

The torque track slide assembly can slidably engage a modular torque track assembly. In operation, the torque track slide assembly can slide along the modular torque track assembly.

The top drive track and slide assembly can also include a modular torque track assembly configured to connect on a drilling rig between a crown of a derrick and a bottom portion of the drilling rig.

The modular torque track assembly can have a top track. The top track can have a top track pin end.

The top track pin end can have two top track connecting pins extending therefrom. Each top track connecting pin can have a top track slot with a top track angled slot surface formed therein.

The top track slots can receive threaded locking lugs to lock the top track to other tracks, such as to a middle track or a bottom track.

The top track can have a suspension and alignment end with a top track plate.

A plurality of vertical suspension means can be affixed to the top track plate.

The top track can have a top track body between the top track pin end and the suspension and alignment end.

The modular torque track assembly can have one or more middle tracks. One middle track can be connected to the top track.

The middle track can have a middle track pin end with middle track connecting pins. Each middle track connecting pin can have a middle track slot therein.

A middle track angled slot surface can be formed in each middle track slot.

The middle track slots can receive threaded locking lugs to lock the middle track to other tracks, such as to the bottom track or another middle track.

The middle track can have a middle track locking end with middle track pin holes. The middle track pin holes can be configured to receive the top track connecting pins or to receive the middle track connecting pins from another middle track.

One or more embodiments can include a middle track locking end recess with a locking device disposed therein.

A middle track body can be disposed between the middle track pin end and the middle track locking end.

The modular torque track assembly can have a bottom track with a bottom track locking end. The bottom track can be connected to the middle track or to the top track.

The bottom track can have bottom track pin holes configured to receive the middle track connecting pins or to receive the top track connecting pins.

In one or more embodiments, the bottom track can have a bottom track locking end recess with a locking device disposed therein.

The bottom track can have a bottom end opposite the bottom track locking end.

The bottom track can have a bottom track body disposed between the bottom track locking end and the bottom end.

The modular torque track assembly can have a plurality of locking devices. Each locking device can be installed in a locking device housing.

In one or more embodiment, each bottom track or middle track locking end recess can have one of the locking device housings disposed therein. Each locking device can be engaged with two of the connecting pins to lock adjacent tracks together.

One or more embodiments can include a bottom track and a middle track without locking end recesses, and with the locking device housings non-removably secured to the middle track body and the bottom track body, such as by welding.

Each locking device can have a threaded turnbuckle housing with hex ends. Each threaded turnbuckle housing with hex ends can include a first threaded locking lug.

The first threaded locking lug can have a first threaded end, a first non-threaded end with an upper non-angled face, and a first non-threaded end with a lower angled face or a flat face.

Each threaded turnbuckle housing with hex ends can include a second threaded locking lug mounted opposite the first threaded locking lug. Each second threaded locking lug can have a second threaded end, a second non-threaded end with a lower angled face, and a second non-threaded end with an upper non-angled face or a flat face.

Each locking device can have a retaining cap disposed around the threaded turnbuckle housing with hex ends. One or more fasteners can secure the retaining cap and the threaded turnbuckle housing with hex ends to the locking device housing.

The threaded turnbuckle housing with hex ends can be rotatable to extend each threaded locking lug, thereby wedging each angled face and each opposing non-angled face between each angled slot surface and the first and second upper flat surfaces. Rotation of the threaded turnbuckle housing with hex ends can axially pull and lock together two adjacent tracks of the modular torque track assembly.

The torque track slide assembly can include a slide body. The slide body can have a plurality of walls, including a first side wall and a second side wall.

The slide body can have a back wall connecting between the first side wall and the second side wall.

The slide body can have a first extension connected to the first side wall and disposed parallel to the back wall.

The slide body can have a second extension connected to the second side wall and disposed parallel to the back wall.

The slide body can have an opening formed axially between the first extension and the second extension. The modular torque track assembly can be configured to be engaged within the opening without engaging the first extension or the second extension.

The slide body can have a top plate and a bottom plate that can be connected along an outside surface of the slide body.

The top plate and a bottom plate can reduce torque applied to the slide body and secure the slide body to the top drive housing.

A plurality of corner ridges can extend axially along the connection of the first side wall and the back wall.

A plurality of corner ridges can extend axially along the connection of the second side wall and the back wall.

A plurality of corner ridges can extend axially along the connection between first side wall and the first extension.

A plurality of corner ridges can extend axially along the connection between the second side wall and the second extension.

Each corner ridge can extend within the slide body and at least partially towards the opening.

The slide body can have one or more inserts disposed therein. Each insert can have a plurality of interlocking tabs extending therefrom, such as from one or more edges of the insert.

Each insert can have a plurality of interlocking spaces. Each interlocking space can be formed between two adjacent interlocking tabs.

Adjacent inserts within the slide body can be connected together. For example, the interlocking tabs of one insert can be interlocked within the interlocking spaces of an adjacent insert, and visa versa, thereby interlocking each insert with each adjacent insert.

For example, a first insert can be disposed on an inner surface of the back wall and can be interlocked with a second insert, which can be disposed on an inner surface of the first side wall.

The first insert can also be interlocked with a third insert, which can be disposed on an inner surface of the second side wall.

The first insert can be interlocked with the plurality of corner ridges that extend axially along the connection of the first side wall and the back wall. The first insert can also be interlocked with the plurality of corner ridges that extend axially along the connection of the second side wall and the back wall. For example, the corner ridges can be engaged within interlocking spaces of the first insert.

The slide body can have a fourth insert disposed on an inner surface of the first extension and interlocked with the second insert.

The fourth insert can also be interlocked with the plurality of corner ridges that extend axially along the connection of the first side wall and the first extension.

The slide body can have a fifth insert disposed on an inner surface of the second extension and interlocking with the third insert.

The fifth insert can also be interlocked with the plurality of corner ridges that extend axially along the connection of the second side wall and the second extension.

In one or more embodiments, each insert can be made of polyamide, a polymer configured to be non-deforming in the presence of torque, a polytetrafluoroethylene polymer, nylon, TEFLON™, or the like.

A plurality of insert fasteners can be engaged through the first extension and the second extension and with the fourth insert and the fifth insert. As such, the plurality of insert fasteners can secure the fourth insert and the fifth insert to the slide body, and the interlocking of the inserts with adjacent inserts and with corner ridges can retain the remainder of the inserts within the slide body.

In one or more embodiments, a plurality of holes can be disposed through the back wall and the first side wall at the connection of the back wall and the first side wall.

A plurality of holes can be disposed through the back wall and the second side wall at the connection of the back wall and the second side wall.

A plurality of holes can be disposed through the first side wall and the first extension at the connection of the first side wall and the first extension.

A plurality of holes can be disposed through the second side wall and the second extension at the connection of the second side wall and the second extension.

A first reinforcement structure can be disposed about the slide body on a first end of the slide body. A second reinforcement structure can be disposed about the slide body on a second end of the slide body. A third reinforcement structure can be disposed about the slide body between the first reinforcement structure and the second reinforcement structure.

Each reinforcement structure can extend along an outside surface of the slide body, such as along the first extension, the first side wall, the back wall, the second side wall, and the second extension.

In one or more embodiments, the plurality of corner ridges can each extend from one of the reinforcement structures, the top plate, the bottom plate, or combinations thereof.

The plurality of corner ridges can each extend through one of the plurality of holes.

Therefore, the slide body can be assembled by engaging the first side wall with the back wall and the first extension. Then the second side wall can be engaged with the back wall and the second extension. The top plate, the bottom plate, and the reinforcement structures, each with corner ridges, can be engaged about the outer surface of the slide body such that the corner ridges extend through the plurality of holes. The first insert can be engaged onto the back wall and retained within the slide body by corner ridges. The second insert and the third insert can be interlocked with the first insert on the first side wall and the second side wall. Also, the fourth insert and the fifth insert can be interlocked with the second insert and the third insert, and then fastened to the first extension and the second extension.

The plurality of interlocking tabs, the plurality of interlocking spaces, and the plurality of corner ridges can be configured and arranged such that the inserts can only be assembled onto the slide body in a single configuration; thereby preventing incorrect assembly of the torque track slide assembly.

In one or more embodiments, the first extension can include a first recess, and the fourth insert can include a first ridge engaged within the first recess. The second extension can include a second recess, and the fifth insert can include a second ridge engaged within the second recess.

Each insert fastener can be engaged through the first extension and the second extension to attach the fourth insert to the first extension, and attach the fifth insert to the second extension. The insert fasteners can be bolts.

The fourth insert and the fifth insert can each have fastener holes for receiving the insert fasteners. The insert fasteners can extend into the fourth insert and the fifth insert without extending past the first ridge and the second ridge, therefore the inserts of the torque track slide assembly can be worn down without the modular torque track assembly engaging the insert fasteners.

In one or more embodiments at least a portion of the interlocking tabs on the second insert can have widths smaller than the other interlocking tabs on the second insert; thereby providing interlocking spaces for the plurality of corner ridges to engage between the interlocking tabs on the fourth insert.

In one or more embodiments at least a portion of the interlocking tabs on the third insert can have widths smaller than the other interlocking tabs on the third insert; thereby providing interlocking spaces for the plurality of corner ridges to engage between the interlocking tabs on the fifth insert.

Turning now to the Figures, FIG. 1 shows a top drive track and slide assembly 10 for use in drilling wells.

A drilling rig 16 is shown with a modular torque track assembly 15 slidably engaged with a torque track slide assembly 12.

The modular torque track assembly 15 can be configured to connect to the drilling rig 16 between a crown 18 of a derrick 20 and a bottom portion 22.

The torque track slide assembly 12 can be configured to connect to a top drive housing 14 of a top drive 11.

Figure 2:
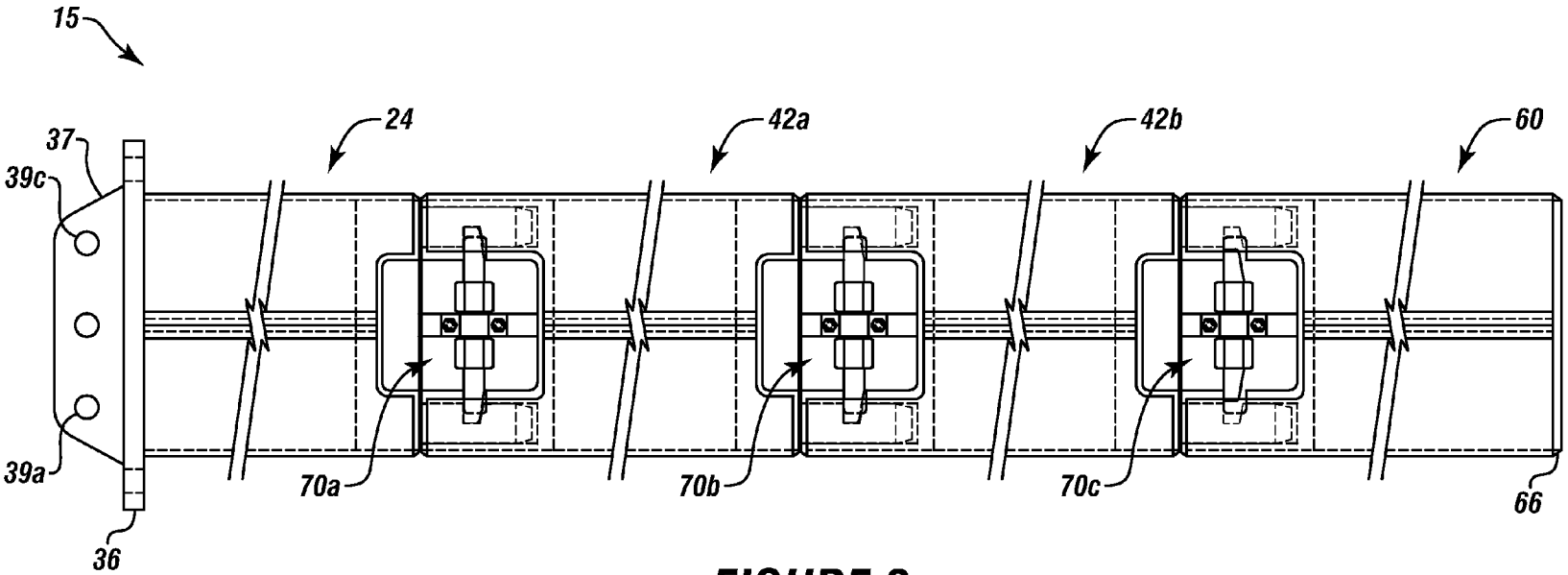
FIG. 2 is a front view of an assembled modular track assembly with a top track, two middle tracks, and a bottom track.

FIG. 2 shows an assembled modular torque track assembly 15 with a top track 24 connected to a first middle track 42*a*, and a second middle track 42*b* connected to the first middle track 42*a* and to a bottom track 60. The bottom track 60 can have a bottom end 66.

The top track 24 can be connected to the first middle track 42*a* with a first locking device 70*a*. The first middle track 42*a* can be connected to the second middle track 42*b* with a second locking device 70*b*. The second middle track 42*b* can be connected to the bottom track 60 with a third locking device 70*c*. The locking devices 70*a*, 70*b*, and 70*c* can hold adjacent tracks of the modular torque track assembly 15 together.

The top track 24 can have a top track plate 36 with a support plate 37 connected thereto, such as at a right angle. The support plate 37 can have a plurality of holes, such as holes 39*a* and 39*c*, disposed therein for attaching the modular torque track assembly 15 to the crown.

A vertical suspension means can be affixed to the plurality of holes 39*a* and 39*c* to hold the modular torque track assembly 15 to the crown. Vertical suspension means can include rotating shackles connected through each of the plurality of holes 39*a* and 39*c*.

Figure 3A:
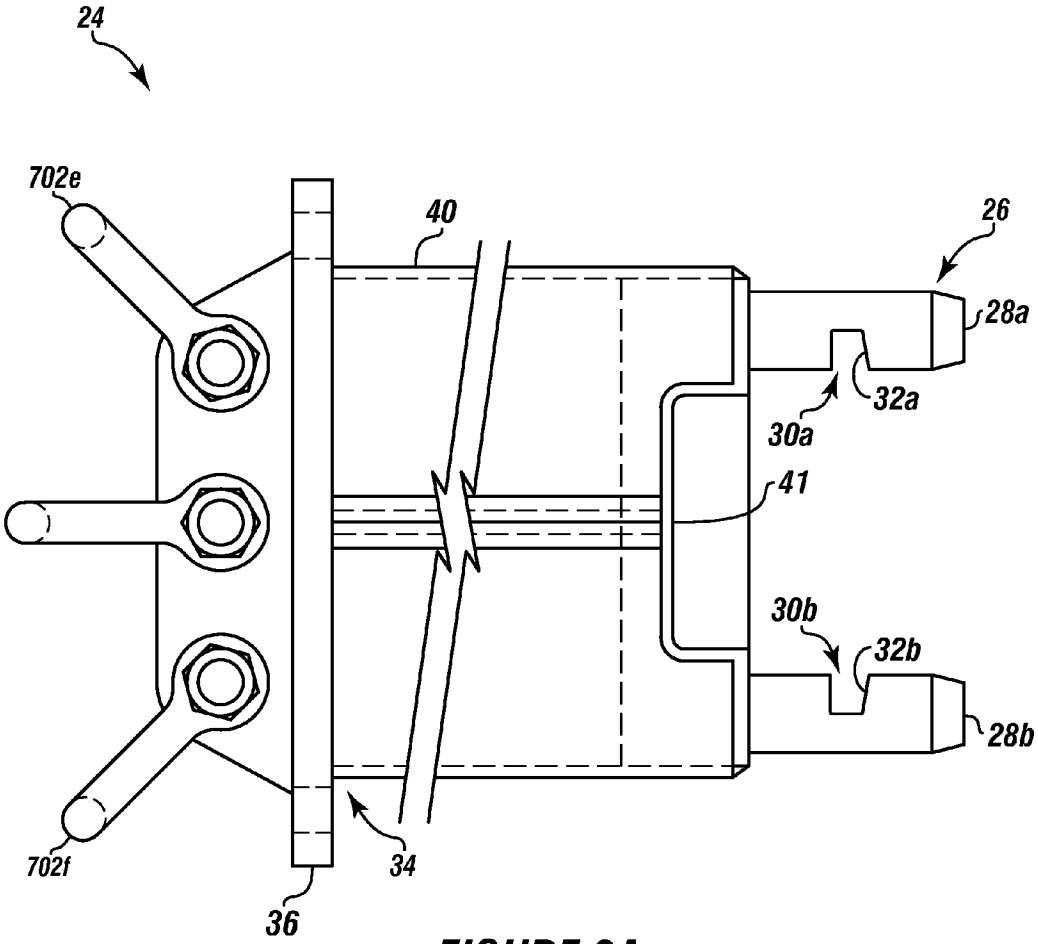
FIG. 3A is a front view of a top track.
Figure 3B:
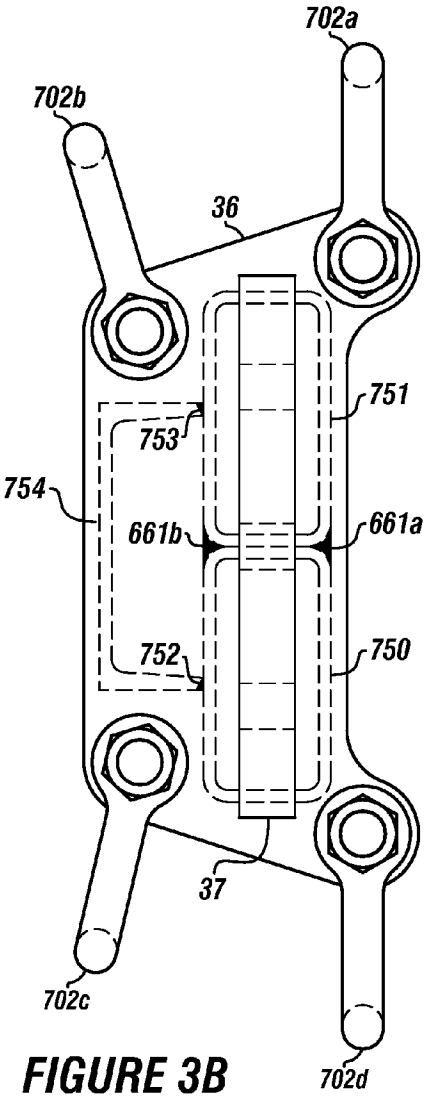
FIG. 3B is a detail of a suspension and alignment end of the top track.

FIG. 3A depicts a side view of a detail of the top track 24, and FIG. 3B depicts a detail of the top track plate 36 and the support plate 37.

The support plate 37 can be mounted or welded, such as at a right angle, to the top track plate 36.

The top track plate 36 can be made of plate steel with a thickness ranging from about 1 inch to about 1.5 inches, a length ranging from about 16 inches to about 24 inches, and a width ranging from about 9 inches to about 15 inches.

The top track 24 can include a top track pin end 26 with top track connecting pins 28*a* and 28*b*. Each top track connecting pin 28*a* and 28*b* can have a top track slot 30*a* and 30*b*. Each top track slot 30*a* and 30*b* can have a top track angled slot surface 32*a* and 32*b*.

The diameter of the top track connecting pins 28*a* and 28*b* can be from about 2 inches to about 3 inches. The length of the top track connecting pins 28*a* and 28*b* can be from about 5 inches to about 6 inches. The top track connecting pins 28*a* and 28*b* can be made of high strength stainless steel, such as 17-4 PH stainless steel.

A suspension and alignment end 34 can be on the top track 24 opposite the top track pin end 26. The suspension and alignment end 34 can have the top track plate 36, which can cover a top track body 40, and can extend beyond the top track body 40.

The top track body 40 can have a width less than the track top plate 36, but can extend beyond a perimeter of the top track connecting pins 28*a* and 28*b*.

A central indentation 41 can be at the top track pin end 26.

The top track 24 can be made of two hollow rectangular steel tubulars, including a first hollow rectangular steel tubular 750 and a second hollow rectangular steel tubular 751. The hollow rectangular steel tubulars 750 and 751 can be welded together, such as with welds 661*a* and 661*b*.

A structural channel of steel 754 can be welded to the hollow rectangular steel tubulars 750 and 751 to align the modular torque track assembly around the torque track slide assembly. Additional welds 752 and 753 can engage the structural channel of steel 754 with the hollow rectangular steel tubulars 750 and 751.

One or more vertical suspension means 702*a*, 702*b*, 702*c*, 702*d*, 702*e*, and 702*f*, such as shackles, can be used to attach the top track 24 to the crown and to other portions of the derrick.

Figure 4A:
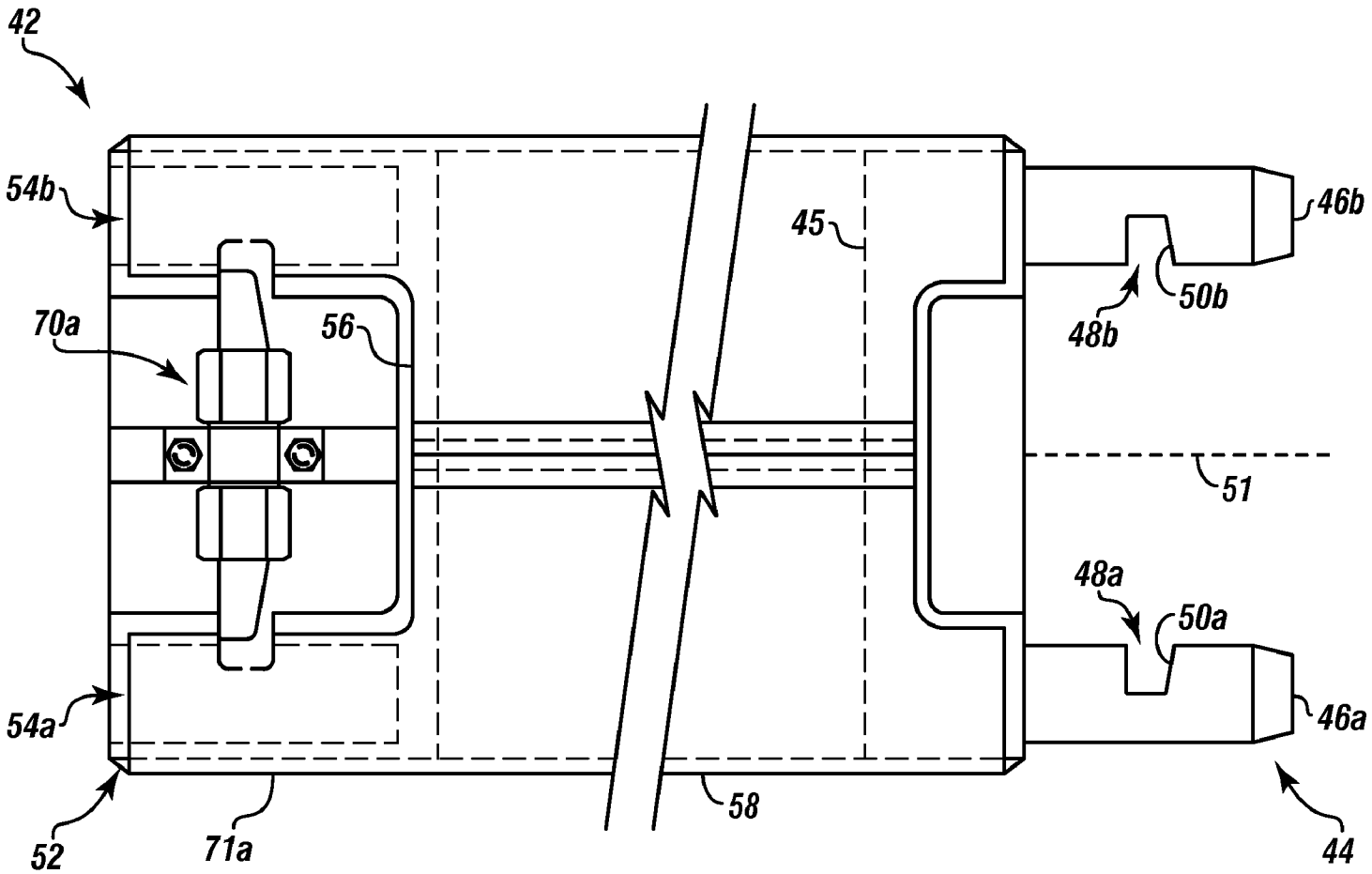
FIG. 4A is a front view of a middle track.

FIG. 4A depicts a middle track 42 having a middle track pin end 44 with a block 45 for supporting two middle track connecting pins 46*a* and 46*b* in the middle track 42.

Each middle track connecting pin 46*a* and 46*b* can have a middle track slot 48*a* and 48*b*, which can face each other. The middle track slots 48*a* and 48*b* can extend partially through the middle track connecting pins 46*a* and 46*b*. The middle track slots 48*a* and 48*b* can each have a depth of ranging from about 1 inch to about 1.75 inches.

Each middle track slot 48*a* and 48*b* can have a middle track angled slot surface 50*a* and 50*b*. The slope of each of the middle track angled slot surface 50*a* and 50*b* can range from about 5 degrees to about 15 degrees.

The middle track 42 can have a central axis 51, and the middle track connecting pins 46*a* and 46*b* can be positioned to extend parallel to the central axis 51, and be spaced apart from the central axis 51, while also being interior of the perimeter of a middle track body 58.

The middle track 42 can have a middle track locking end 52 with middle track pin holes 54*a* and 54*b* for receiving connecting pins from the top track or from another middle track. The middle track pin holes 54*a* and 54*b* can have a diameter slightly greater than the connecting pins from the top track or another middle track to allow for a snug fit of the connecting pins therein. The middle track pin holes 54*a* and 54*b* can have a depth nominally the same as the connecting pins from the top track or another middle track. The middle track connecting pins 46*a* and 46*b* and the middle track pin holes 54*a* and 54*b* can be rectangular, square, or cylindrical.

A middle track locking end recess 56 can be formed in the middle track body 58 for receiving the first locking device 70*a*. The first locking device 70*a* can be in a first locking device housing 71*a*.

Figure 4B:
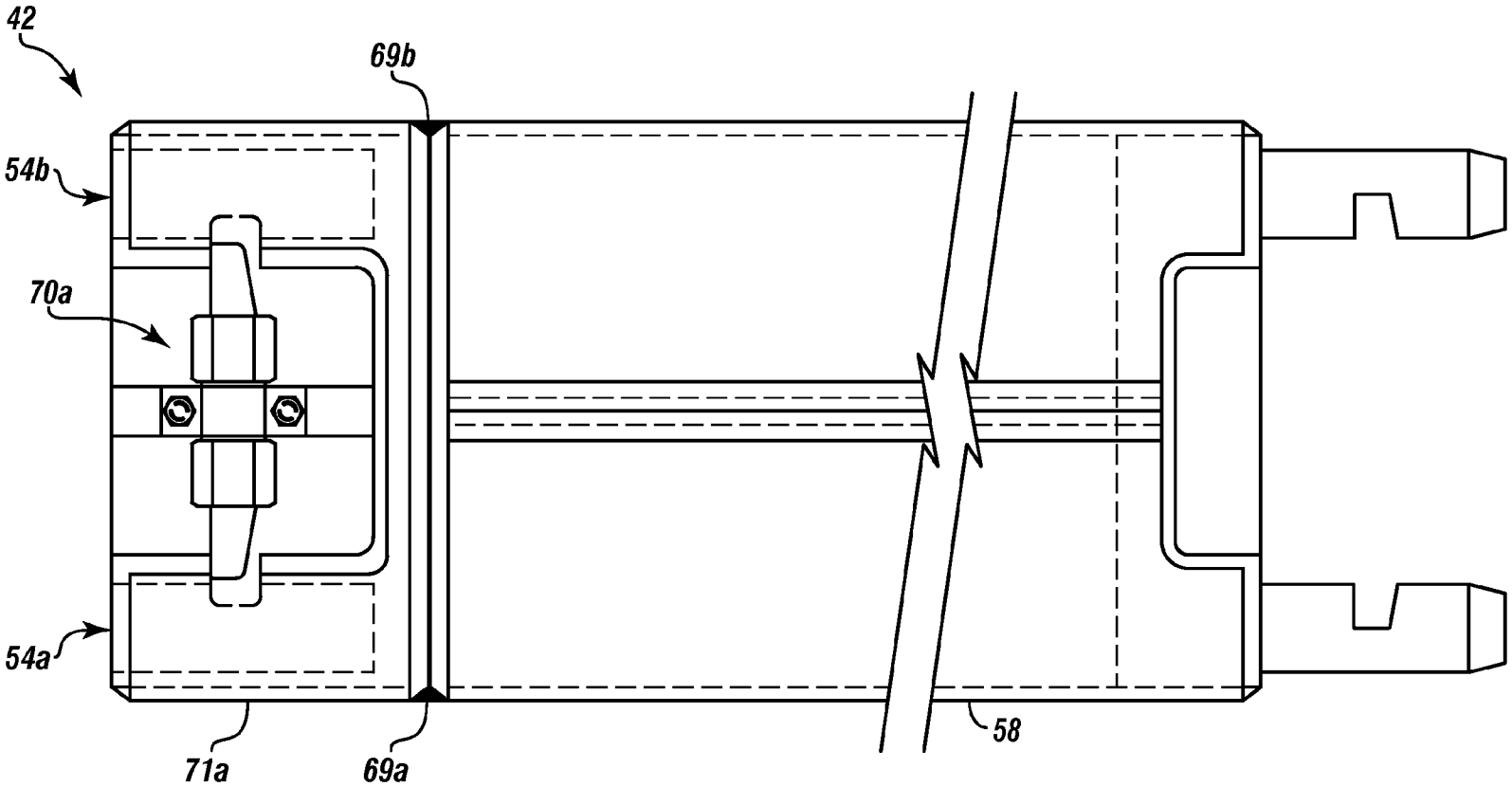
FIG. 4B is a front view of another embodiment of the middle track.

FIG. 4B shows another embodiment of the middle track 42 having the first locking device 70*a* in the first locking device housing 71*a*.

The first locking device housing 71*a* can be welded to the middle track body 58, such as with welds 69*a* and 69*b*.

The middle track pin holes 54*a* and 54*b* can be disposed in the first locking device housing 71*a*.

Figure 5A:
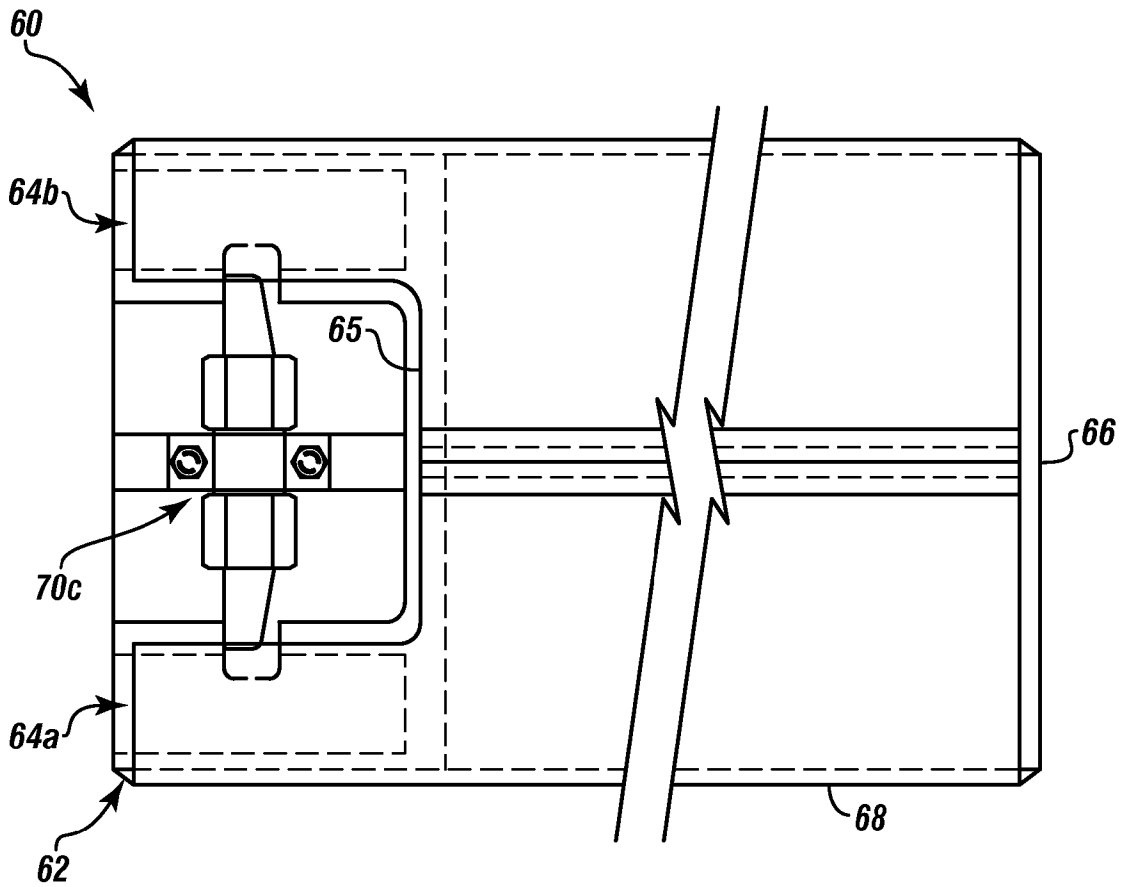
FIG. 5A is a front view of a bottom track.

FIG. 5A depicts an embodiment of the bottom track 60 with a bottom track locking end 62, the bottom end 66, and a bottom track body 68 therebetween.

A bottom track locking end recess 65 can be formed in the bottom track locking end 62 to hold the third locking device 70*c*.

The bottom track 60 can have bottom track pin holes 64*a* and 64*b* for receiving connecting pins from one of the middle tracks or the top track.

Figure 5B:
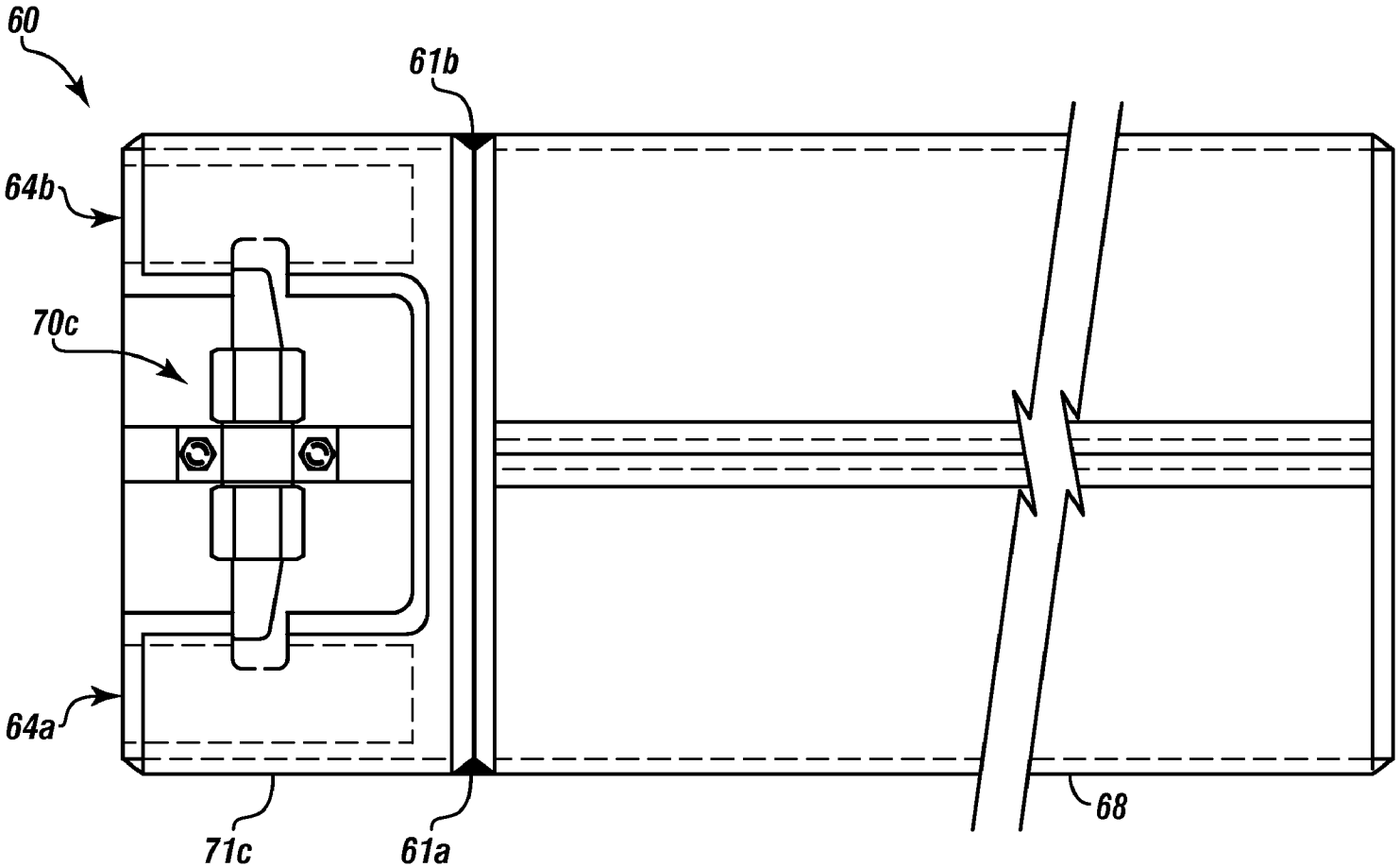
FIG. 5B is a front view of another embodiment of the bottom track.
Figure 6A:
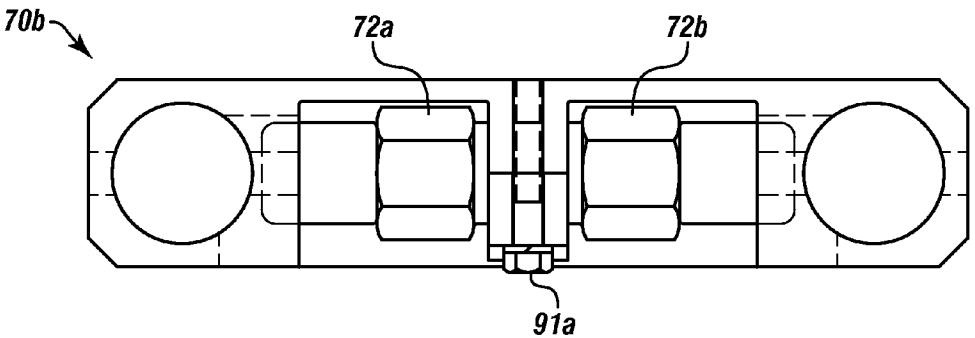
FIGS. 6A-6D depict detailed views of a locking end recess with a locking device.
Figure 6B:
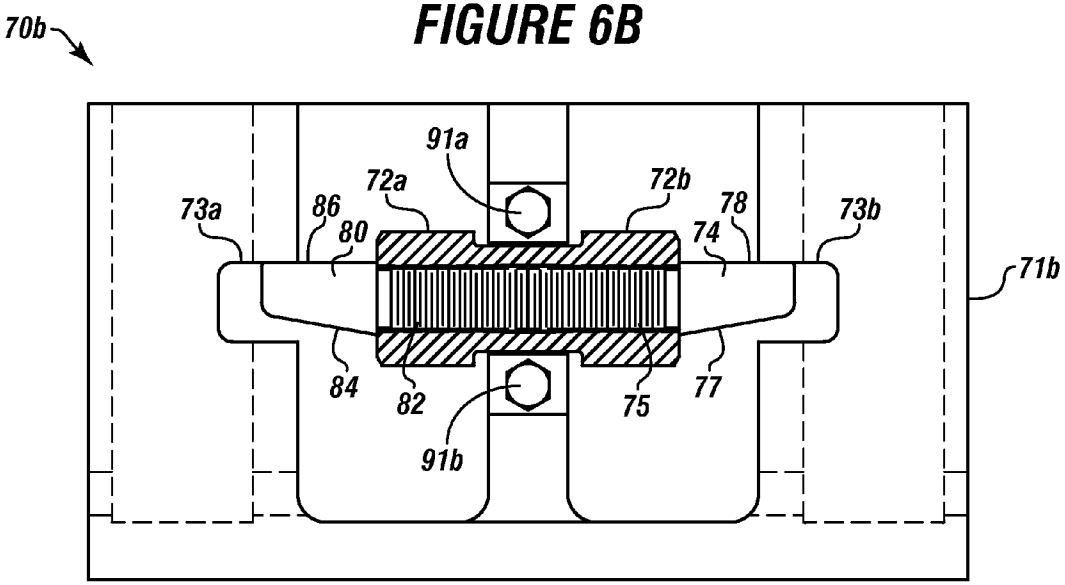
Figure 6C:
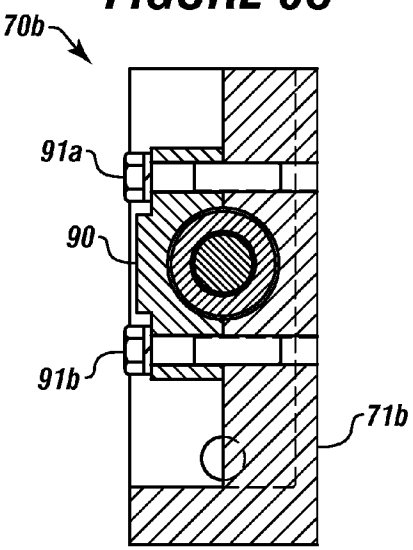
Figure 6D:
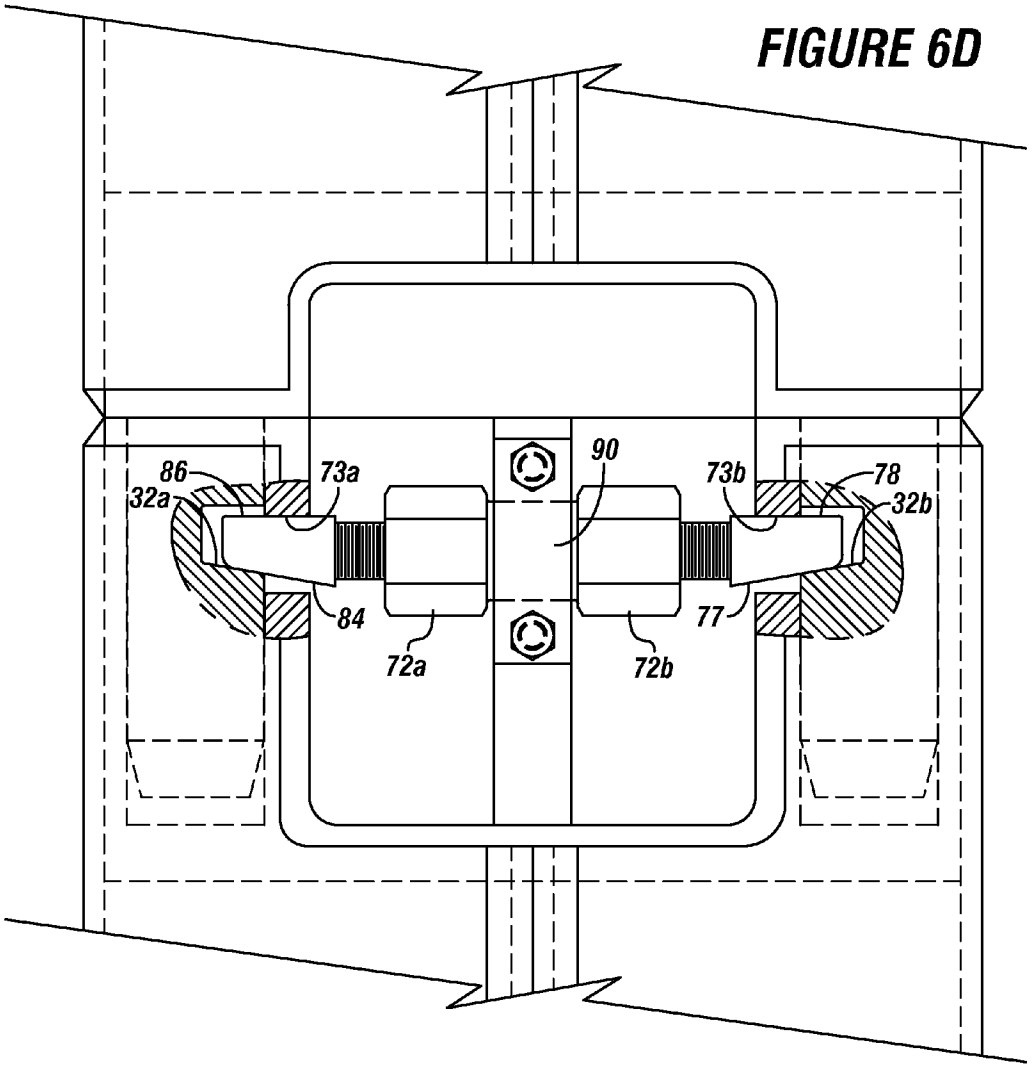

FIG. 5B depicts another embodiment of the bottom track 60 with a third locking device housing 71*c* welded to the bottom track body 68 with welds 61*a* and 61*b*.

The third locking device housing 71*c* can include the third locking device 70*c* and the bottom track pin holes 64*a* and 64*b*.

FIGS. 6A-6D show different views of the second locking device 70*b*.

The second locking device 70*b* can have a threaded turnbuckle housing with hex ends 72*a* and 72*b* connected by a narrower portion. Fasteners 91*a* and 91*b* can hold a retaining cap 90 in place, thereby retaining the threaded turnbuckle housing with hex ends 72*a* and 72*b*.

The threaded turnbuckle housing with hex ends 72*a* and 72*b* can have a first threaded locking lug 74 with a first threaded end 75, a first non-threaded end with an upper non-angled face 78, and a first non-threaded end with a lower angled face 77 or a flat face.

The threaded turnbuckle housing with hex ends 72*a* and 72*b* can have a second threaded locking lug 80 mounted opposite the first threaded locking lug 74.

The second threaded locking lug 80 can have a second threaded end 82, a second non-threaded end with a lower angled face 84, and a second non-threaded end with an upper non-angled face 86 or a flat face.

The threaded turnbuckle housing with hex ends 72*a* and 72*b* can have a first upper flat surface 73*a* and a second upper flat surface 73*b*, which can provide a wedging force when the first threaded locking lug 74 and the second threaded locking lug 80 extend into the middle track slots or top track slots, thereby urging the adjacent tracks of the modular torque track assembly together in a secure fit with a high shear force.

The second locking device 70*b* can be installed in a second locking device housing 71*b*, which can be mounted into one of the locking end recesses of the bottom track or a middle track, or welded to a planar face of one of the tracks. The second locking device housing 71*b* can lock adjacent tracks of the modular torque track assembly together.

The second locking device housing 71*b* can urge the first non-threaded end with a lower angled face 77 and the second non-threaded end with a lower angled face 84 against the top track angled slot surfaces 32*a* and 32*b*.

For example, the threaded turnbuckle housing with hex ends 72*a* and 72*b* can be rotatable to extend the first and second threaded locking lugs 74 and 80 to wedge each non-threaded end with a lower angled face 77 and 84 against the top track angled slot surfaces 32*a* and 32*b*, and to wedge each non-threaded end with an upper non-angled face 78 and 86 against the upper flat surfaces 73*a* and 73*b*, thereby axially pulling together and locking together two tracks.

Figure 7:
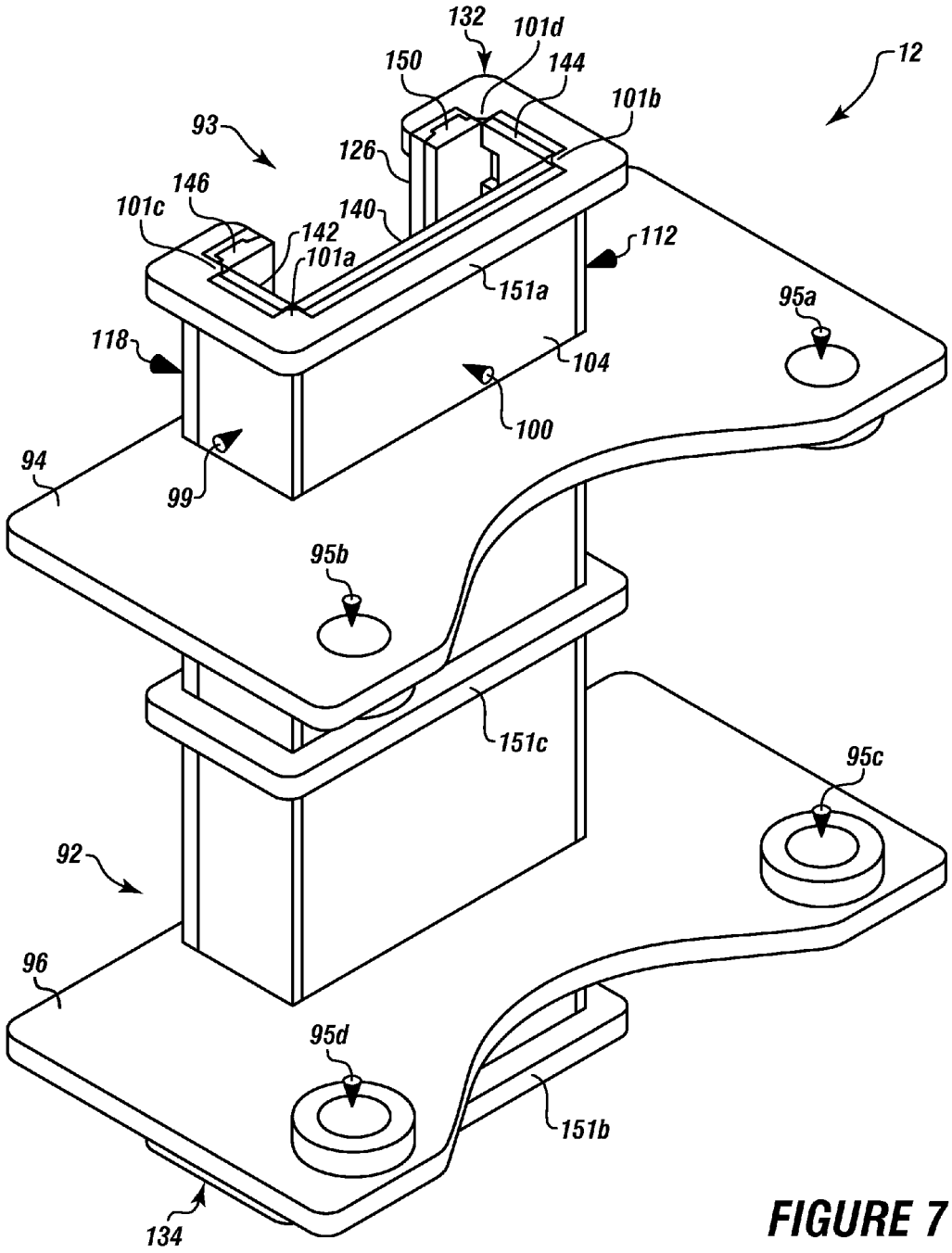
FIG. 7 depicts a torque track slide assembly with inserts.

FIG. 7 depicts the torque track slide assembly 12 having a plurality of inserts disposed therein.

The torque track slide assembly 12 can have a slide body 92 having an opening 93.

The slide body 92 can have a rectangular shape, a length ranging from about 3 feet to about 6 feet, and a width ranging from about 12 inches to about 24 inches.

The torque track slide assembly 12 can have a top plate 94 secured around the slide body 92, such as with a weld.

A bottom plate 96 can also be secured around the slide body 92, such as with a weld.

The top plate 94 and the bottom plate 96 can be attached to the top drive housing, and can maintain the slide body 92 at safe working distance from the top drive housing. For example, in one or more embodiments the top plate 94 and the bottom plate 96 can maintain the slide body 92 no less than six inches away from the top drive housing. The top plate 94 and the bottom plate 96 can both be made of plate steel.

The top plate 94 and the bottom plate 96 can include fastener holes 95*a*, 95*b*, 95*c*, and 95*d* for attaching the torque track slide assembly 12 to the top drive housing.

The torque track slide assembly 12 can have a plurality of walls forming the opening 93. The modular torque track assembly can engage within the opening 93, and the torque track slide assembly 12 can slide along the modular torque track assembly. Each of the plurality of walls can be made of plastic, steel, or another durable material.

The plurality of walls can include a back wall 100 having a back wall outer surface 104. In one or more embodiments, the back wall 100 can have a length ranging from about 4 feet to about 5 feet and a width ranging from about 14 inches to about 18 inches.

The plurality of walls can include a first side wall 99 connected to the back wall 100, such as at a right angle.

The plurality of walls can include a second side wall 112 connected to the back wall 100 opposite the first side wall 99, such as at a right angle.

The plurality of walls can include a first extension 118 extending from the first side wall 99 opposite the back wall 100. The first extension 118 can extend parallel to the back wall 100 and towards the second side wall 112.

The plurality of walls can include a second extension 126 extending from the second side wall 112 opposite the back wall 100. The second extension 126 can extend parallel to the back wall 100 and towards the first side wall 99.

The torque track slide assembly 12 can include a plurality of inserts. Each insert can be disposed along an inner surface of one of the plurality of walls. At least one of the inserts can be retained by a plurality of corner ridges, such as corner ridge 101*a*, corner ridge 101*b*, corner ridge 101*c*, and corner ridge 101*d*.

Each insert can include a plurality of interlocking tabs that interlock with the corner ridges and/or with interlocking spaces of adjacent inserts.

For example, the plurality of inserts can include a first insert 140 retained within the slide body 92 by the corner ridges 101*a* and 101*b*, as well as by other corner ridges not shown in this Figure.

The plurality of inserts can include a second insert 142, which can have a plurality of interlocking tabs interlocked with a plurality of interlocking spaces of the first insert 140, thereby retaining the second insert 142 in the slide body 92.

The plurality of inserts can include a third insert 144, which can have a plurality of interlocking tabs interlocked with a plurality of interlocking spaces of the first insert 140, thereby retaining the third insert 144 in the slide body 92.

The plurality of inserts can include a fourth insert 146, which can have a plurality of interlocking tabs interlocked with a plurality of interlocking spaces of the second insert 142, thereby further retaining the fourth insert 146 within the slide body 92.

The plurality of inserts can include a fifth insert 150, which can have a plurality of interlocking tabs interlocked with a plurality of interlocking spaces of the third insert 144, thereby further retaining the fifth insert 150 within the slide body 92.

The torque track slide assembly 12 can include one or more reinforcement structures.

For example, the torque track slide assembly 12 can include a first reinforcement structure 151*a* disposed about the slide body 92 on a first end 132.

A second reinforcement structure 151*b* can be disposed about the slide body 92 on a second end 134.

A third reinforcement structure 151*c* can be disposed about the slide body 92 between the first reinforcement structure 151*a* and the second reinforcement structure 151*b*.

The reinforcement structures 151*a*, 151*b*, and 151*c* can engage around the slide body 92 on the outer surface thereof.

Figure 8:
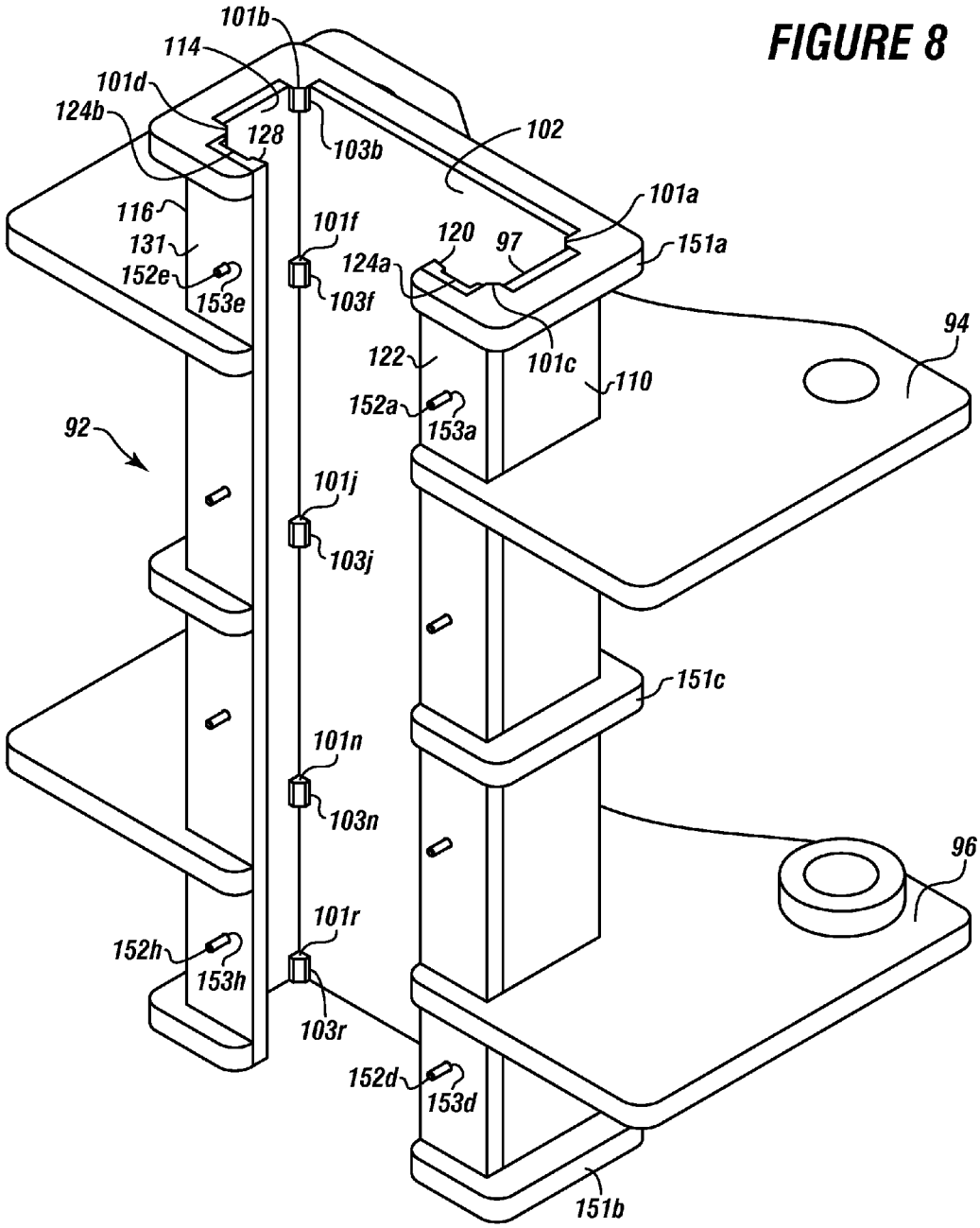
FIG. 8 depicts the torque track slide assembly without the inserts.

FIG. 8 depicts an embodiment of the slide body 92 without the plurality of inserts disposed therein.

The slide body 92 can have a back wall inner surface 102, a first side wall inner surface 97, a first side wall outer surface 110, a second side wall inner surface 114, a second side wall outer surface 116, a first extension inner surface 120, a first extension outer surface 122, a second extension inner surface 128, and a second extension outer surface 131.

The first extension can have a first recess 124*a* disposed along a length of the first extension inner surface 120 for receiving the fourth insert.

The second extension can have a second recess 124*b* disposed along a length of the second extension inner surface 128 for receiving the fifth insert.

The slide body 92 can include a plurality of corner ridges, such as corner ridges 101*a*, 101*b*, 101*c*, 101*d*, 101*f*, 101*j*, 101*n*, and 101*r*.

Each of the plurality of corner ridges can be disposed along each corner of the slide body 92 formed by the plurality of walls.

Each of the plurality of corner ridges can generally face the modular torque track slide assembly and the opening of the torque track slide assembly.

Each of the plurality of corner ridges can engage at least one of the inserts for retaining the inserts within the slide body 92.

Each corner ridge of the plurality of corner ridges disposed inside a corner formed between the back wall and the first side wall can be engaged between two adjacent interlocking tabs and within the interlocking spaces of the first insert, thereby retaining the first insert within the slide body 92.

Each corner ridge disposed inside a corner formed between the back wall and the second side wall can be engaged between two adjacent interlocking tabs and within the interlocking spaces of the first insert, thereby retaining the first insert within the slide body 92.

Each corner ridge disposed inside the corner formed between the first side wall and the first extension can be engaged between two adjacent interlocking tabs and within the interlocking spaces of the fourth insert, thereby retaining the fourth insert within the slide body 92.

Each corner ridge disposed inside the corner formed between the second side wall and the second extension can be engaged between two adjacent interlocking tabs and within the interlocking spaces of the fifth insert, thereby retaining the fifth insert within the slide body 92.

Each of the plurality of corner ridges can extend from one of the reinforcement structures 151*a*, 151*b*, and 151*c*, the top plate 94, and/or the bottom plate 96, and through one of a plurality of holes, such as holes 103*b*, 103*f*, 103*j*, 103*n*, and 103*r*.

For example, the hole 103*b* can be formed through the back wall and the second side wall, and the corner ridge 101*b* can be formed on the first reinforcement structure 151*a*. The first reinforcement structure 151*a* can be attached to the slide body 92 such that the corner ridge 101*b* extends through the hole 103*b*.

Insert fasteners, such as insert fastener 152*a*, 152*d*, 152*e*, and 152*h*, can extend through insert fastener holes 153*a*, 153*d*, 153*e*, and 152*h* to retain the fourth insert and the fifth insert within the slide body 92. The insert fasteners can extend through the first extension and the second extension without extending past the first recess 124*a* and the second recess 124*b*.

Figure 9A:
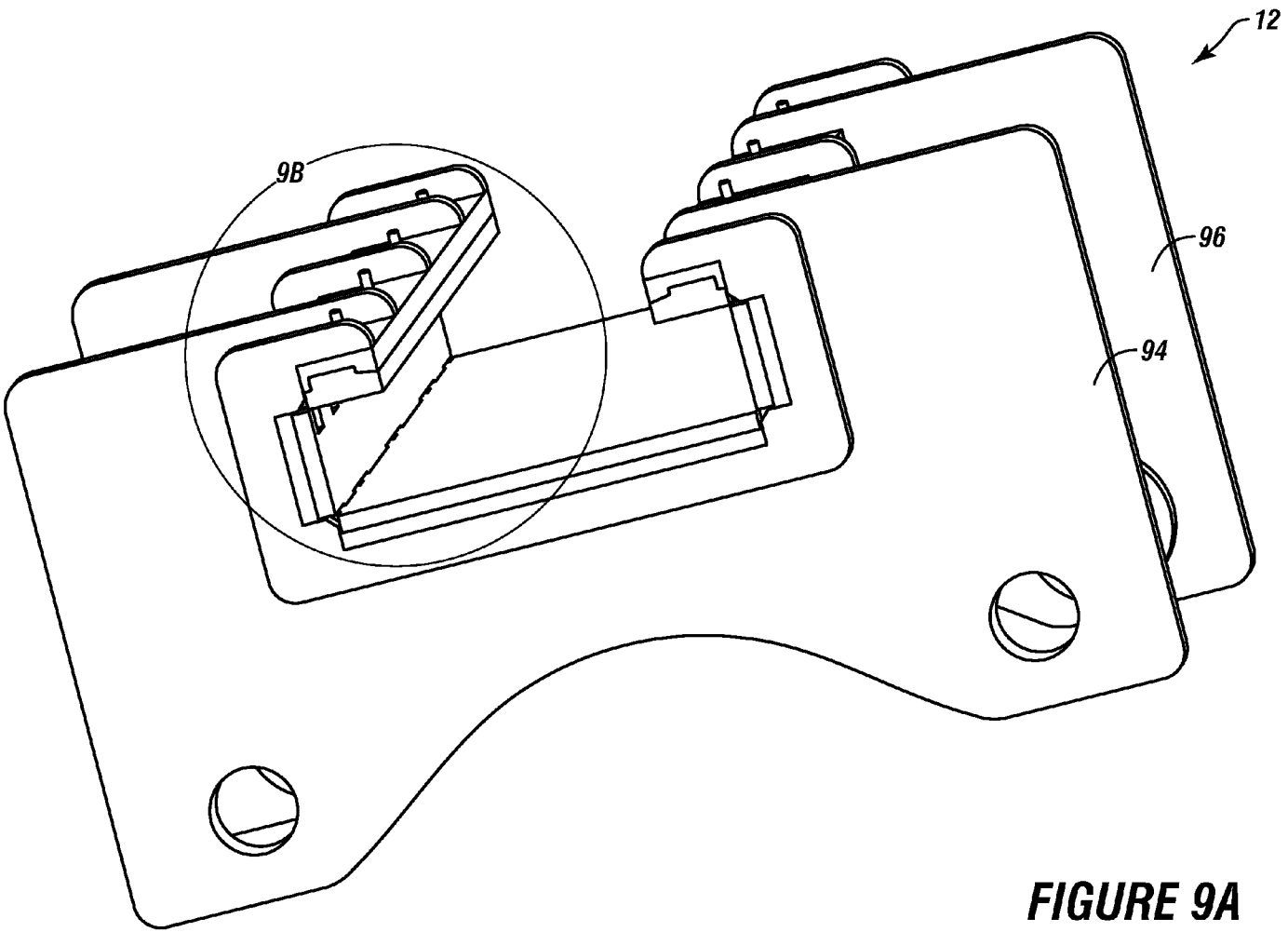
FIGS. 9A-9B depict a detail view of an inner portion of the torque track slide assembly.
Figure 9B:
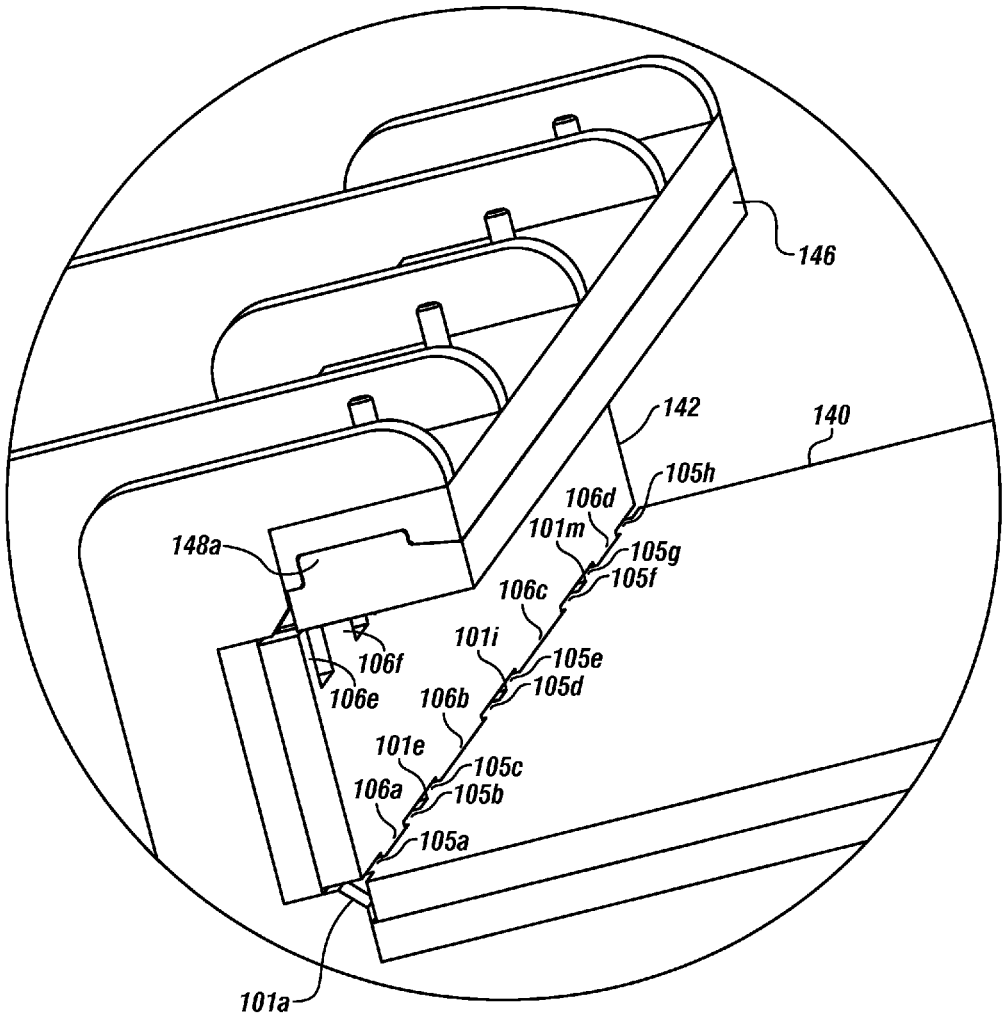

FIGS. 9A-9B depict a view of an inner portion of the torque track slide assembly 12 with the top plate 94 and the bottom plate 96, showing the connection between the first insert 140 and the second insert 142.

In one or more embodiments, the fourth insert 146 can have a first ridge 148*a*. In operation, the insert fasteners attaching the fourth insert 146 to the first extension will only extend into the first ridge 148*a* of the fourth insert 146 without extending past the first ridge 148*a*, thereby allowing the fourth insert 146 to be completely worn down before requiring replacement as the torque track slide assembly 12 slides on the modular torque track assembly, because the insert fasteners will not engage the modular torque track assembly.

The first insert 140 can have a first plurality of interlocking tabs 105*a*, 105*b*, 105*c*, 105*d*, 105*e*, 105*f*, 105*g*, and 105*h*.

The first plurality of interlocking tabs 105*a*-105*h* can extend from a first edge of the first insert 140, as shown.

Additionally, the first insert 140 can have another plurality of interlocking tabs formed on the opposite edge of the first insert 140 in the same manner and configuration as the first plurality of interlocking tabs 105*a*-105*h*.

A corner ridge 101*a* can be engaged over the interlocking tab 105*a*. A corner ridge 101*e* can be engaged between the interlocking tabs 105*b* and 105*c*. A corner ridge 101*i* can be engaged between the interlocking tabs 105*d* and 105*e*. The corner ridge 101*m* can be engaged between the interlocking tabs 105*f* and 105*g*.

The second insert 142 can have a second plurality of interlocking tabs 106*a*, 106*b*, 106*c*, 106*d*, 106*e*, and 106*f* extending from two edges of the second insert 142.

At least a portion of the second plurality of interlocking tabs 106*a*-106*f* can be interlocked within at least a portion of interlocking spaces of the first plurality of interlocking tabs 105*a*-105*h*.

The engagement between the first insert 140 and the third insert can be substantially the same as depicted here between the first insert 140 and the second insert 142.

Figure 10A:
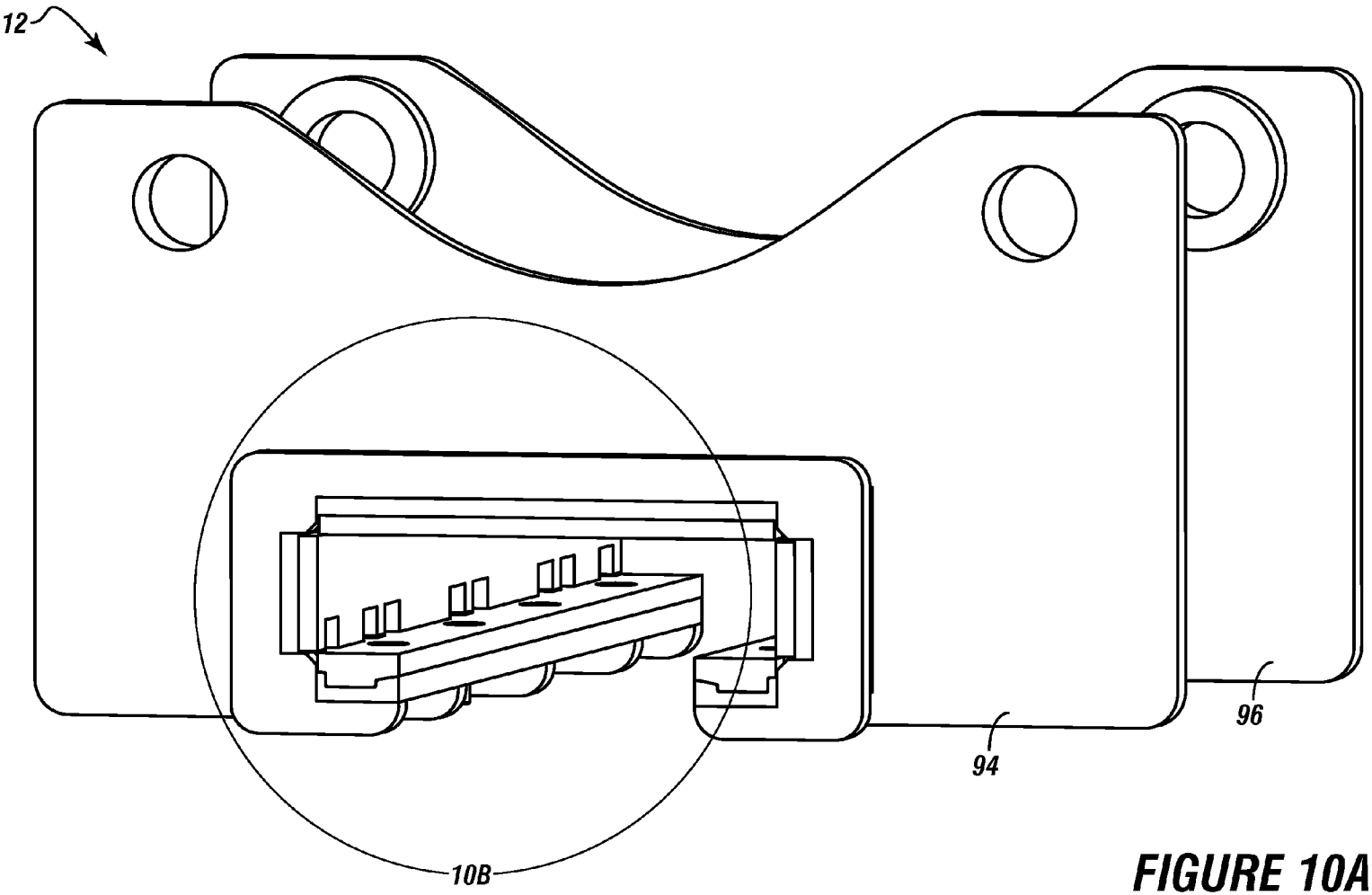
FIGS. 10A-10B depict another detail view of an inner portion of the torque track slide assembly.
Figure 10B:
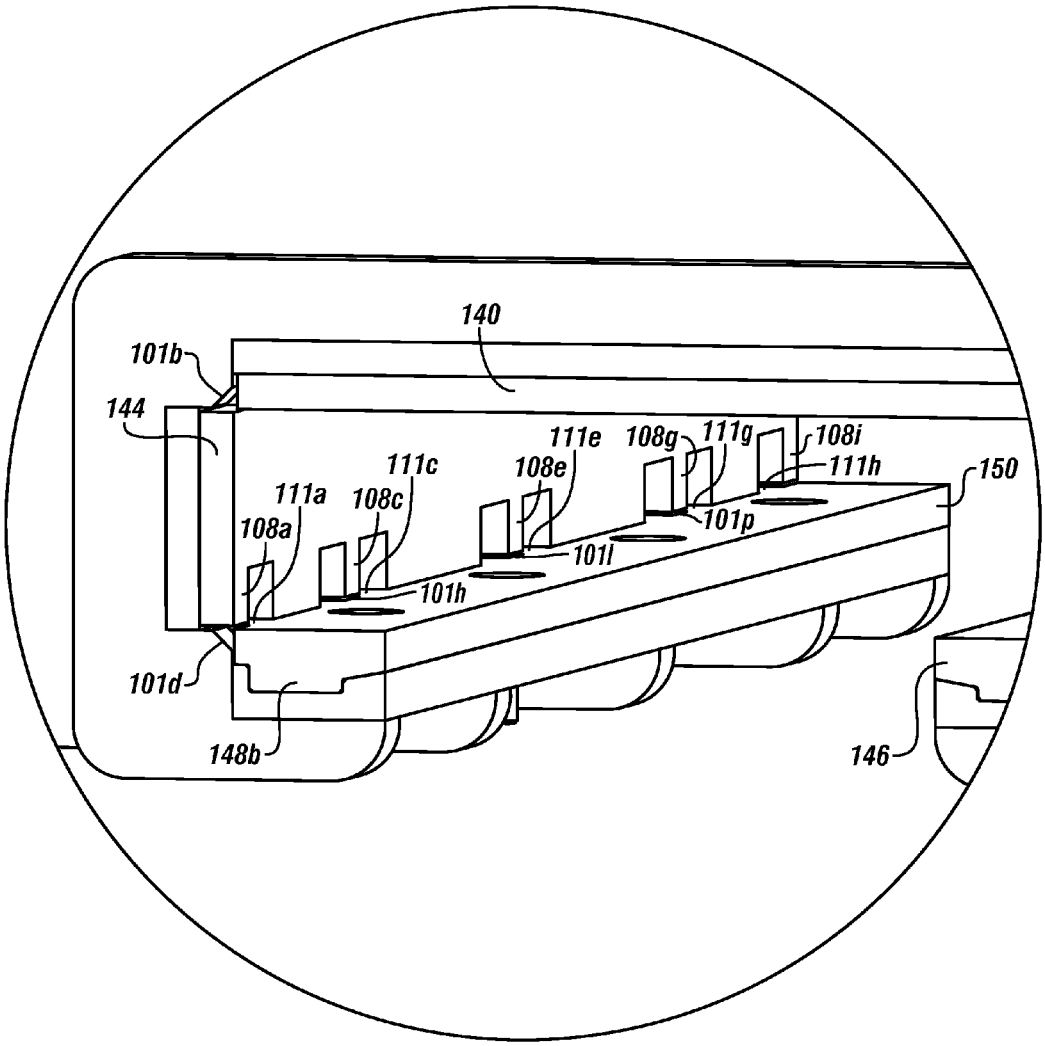

FIGS. 10A-10B depict detailed views of an inner portion of the torque track slide assembly 12 having the top plate 94 and the bottom plate 96, showing the connection between the third insert 144 and the fifth insert 150.

In one or more embodiments, the fifth insert 150 can have a second ridge 148*b*. In operation, the insert fasteners attaching the fifth insert 150 to the second extension will only extend into the second ridge 148*b* of the fifth insert 150 without extending past the second ridge 148*b*, thereby allowing the fifth insert 150 to be completely worn down before requiring replacement as the torque track slide assembly 12 slides on the modular torque track assembly, because the insert fasteners will not engage the modular torque track assembly.

The third insert 144 can be engaged on the second side wall inner surface, and can include a third plurality of interlocking tabs, such as interlocking tabs 108*a*, 108*c*, 108*e*, 108*g*, and 108*i*, which can extend from each edge of the third insert 144.

The fifth insert 150 can be engaged on the second extension inner surface, and can include a fifth plurality of interlocking tabs, such as interlocking tabs 111*a*, 111*c*, 111*e*, 111*g*, and 111*h*.

Each corner ridge disposed along the corner formed at the connection between the second side wall and the second extension can be engaged between two adjacent interlocking tabs and within an interlocking space of the fifth insert 150, thereby retaining the fifth insert 150 within the slide body. For example, the corner ridges 101*d*, 101*h*, 101*l*, and 101*p* can be engaged within interlocking spaces of the fifth insert 150.

At least a portion of the fifth plurality of interlocking tabs can be engaged within interlocking spaces between at least a portion of the third plurality of interlocking tabs.

The connection between the second insert and the fourth insert 146 can be the same as shown here with respect to the connection between the third insert 144 and the fifth insert 150. Also, the connection between the fourth insert 146 and a portion of the plurality of corner ridges can be the same as depicted here with respect to the fifth insert 150 and the corner ridges 101*d*, 101*h*, 101*l*, and 101*p*.

The first insert 140 is also shown in this Figure engaged with the corner ridge 101*b*.

Figure 11:
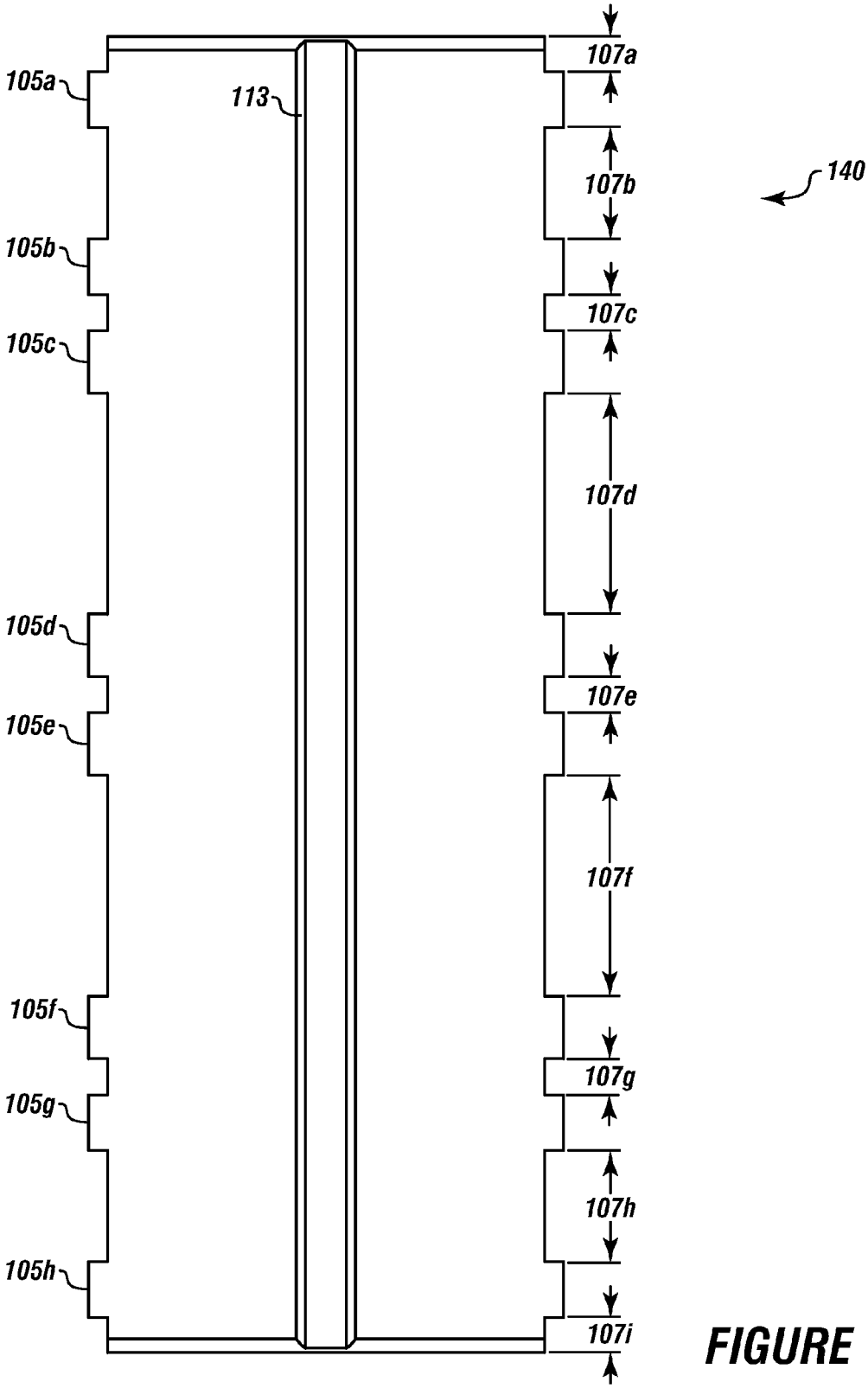
FIG. 11 is a detail view of a first insert.

FIG. 11 depicts a detail of the first insert 140. The first insert 140 can have a first plurality of interlocking tabs 105*a*-105*h*. The first insert 140 can have corresponding interlocking tabs disposed along the opposite edge of the first insert 140.

The first plurality of interlocking tabs 105*a*-105*h* can be configured to have various interlocking spaces formed therebetween, such as the first plurality of interlocking spaces 107*a*-107*i*.

For example, a first interlocking space 107*a* can be configured to be disposed just below a corner ridge.

A second interlocking space 107*b*, a fourth interlocking space 107*d*, a sixth interlocking space 107*f*, and an eight interlocking space 107*h* can be configured to receive an interlocking tab from an adjacent insert, such as from the second insert or the third insert.

A third interlocking space 107*c*, a fifth interlocking space 107*e*, and a seventh interlocking space 107*g* can each be configured to receive a corner ridge to hold a position of the first insert 140 within the slide body.

A ninth interlocking space 107*i* can be configured to be disposed just above a corner ridge to hold the first insert 140 within the slide body.

In one or more embodiments, the first insert 140 can have a weld clearance groove 113 configured to clear a weld between two hollow rectangular steel tubulars of the torque track slide assembly. In one or more embodiments, the hollow rectangular steel tubulars can be replaced with solid tubulars, cylindrical shaped tubulars, or another shaped tubular that can form a solid weld.

Figure 12:
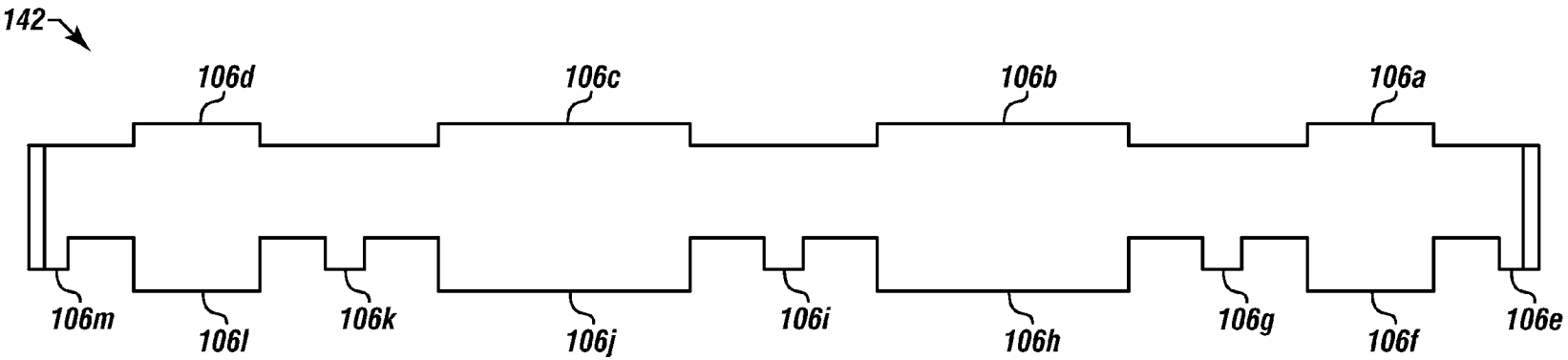
FIG. 12 is a detail view of a second insert.

FIG. 12 depicts an embodiment of the second insert 142. The second insert 142 can have a second plurality of interlocking tabs 106*a*-106*m*.

The second plurality of interlocking tabs 106*a*-106*m* can be configured to have various sized interlocking spaces formed therebetween for engagement interlocking tabs of adjacent inserts, such as the first insert and the fourth insert.

The second insert 142 can provide interlocking spaces for corner ridges to engage between the interlocking tabs of an adjacent insert. For example, the interlocking tab 106*g* can have a width less than the interlocking tabs 106*f* and 106*h*, thereby providing an interlocking space to allow for a corner ridge to engage between the interlocking tabs of the first insert.

The third insert can be configured and arranged exactly as the second insert 142.

Figure 13:
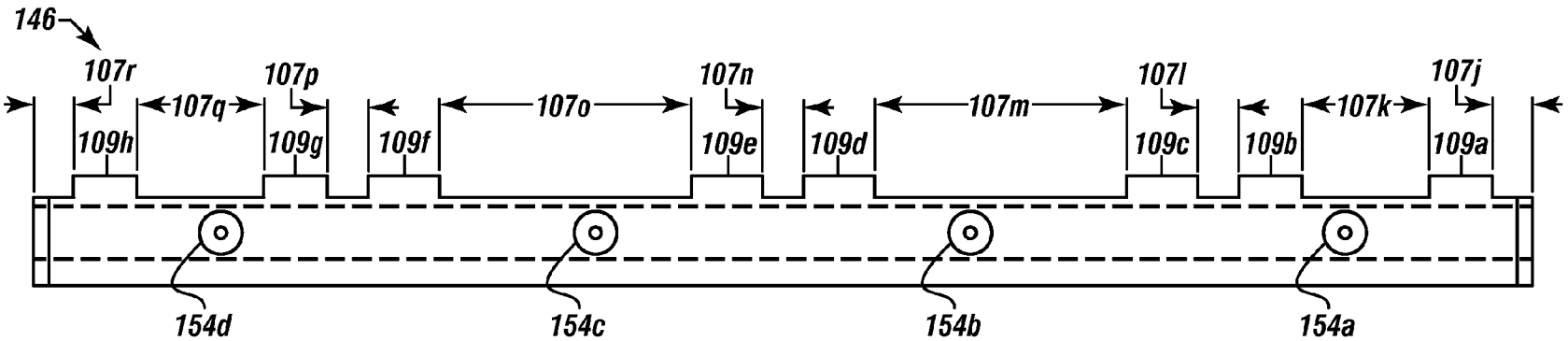
FIG. 13 is a detail view of a fourth insert.

FIG. 13 depicts an embodiment of the fourth insert 146 having a fourth plurality of interlocking tabs 109*a*-109*h* disposed along one edge of the fourth insert 146.

A fourth plurality of interlocking spaces 107*j*-107*r* can accept the interlocking tabs of the second insert.

A portion of the plurality of interlocking spaces can accept the corner ridges of the slide body.

Also shown are fastener holes 154*a*-154*d* for receiving the plurality of insert fasteners.

The fifth insert can be configured and arranged exactly like the fourth insert 146 as shown.

While these embodiments have been described with emphasis on the embodiments, it should be understood that within the scope of the appended claims, the embodiments might be practiced other than as specifically described herein.

What is claimed is:

1. A top drive track and slide assembly comprising:

a. a modular torque track assembly configured to connect on a drilling rig between a crown of a derrick and a bottom portion of the drilling rig; and b. a torque track slide assembly configured to connect to a top drive housing of a top drive, and configured to slidably engage the modular torque track assembly, the torque track slide assembly comprising:

(i) a slide body comprising:

(a) a first side wall, a second side wall, and a back wall connected between the first side wall and the second side wall;

(b) a first extension connected to the first side wall and disposed parallel to the back wall;

(c) a second extension connected to the second side wall and disposed parallel to the back wall; and (d) an opening formed axially between the first extension and the second extension, wherein the modular torque track assembly is configured to be engaged within the opening, and wherein the torque track slide assembly is configured to slide along the modular torque track assembly;

(ii) a top plate and a bottom plate connected to the slide body for reacting torque applied to the slide body and securing the slide body to the top drive housing;

(iii) a plurality of corner ridges extending axially along:

(a) a connection of the first side wall and the back wall;

(b) a connection of the second side wall and the back wall;

(c) a connection between first side wall and the first extension; and (d) a connection between the second side wall and the second extension, wherein each corner ridge extends within the slide body towards the opening;

(iv) a first insert on the back wall interlocking a second insert on the first side wall and interlocking a third insert on the second side wall, wherein the first insert is interlocked with the plurality of corner ridges that extend axially along the connection of the first side wall and the back wall and with the plurality of corner ridges that extend axially along the connection of the second side wall and the back wall;

(v) a fourth insert on the first extension interlocking with the second insert, wherein the fourth insert is interlocked with the plurality of corner ridges that extend axially along the connection of the first side wall and the first extension;

(vi) a fifth insert on the second extension interlocking with the third insert, wherein the fifth insert is interlocked with the plurality of corner ridges that extend axially along the connection of the second side wall and the second extension, wherein each insert comprises a plurality of interlocking tabs interlocked with a plurality of interlocking spaces of adjacent inserts, and wherein each insert comprises: polyamide, a polymer configured to be non-deforming in the presence of torque, or a polytetrafluoroethylene polymer; and (vii) a plurality of insert fasteners engaging through the first extension and the second extension securing the fourth insert and the fifth insert to the slide body.

2. The top drive track and slide assembly of claim 1, further comprising a plurality of holes disposed:

a. through the back wall and the first side wall at the connection of the back wall and the first side wall;
b. through the back wall and the second side wall at the connection of the back wall and the second side wall;
c. through the first side wall and the first extension at the connection of the first side wall and the first extension; and
d. through the second side wall and the second extension at the connection of the second side wall and the second extension.

3. The top drive track and slide assembly of claim 2, further comprising:
a. a first reinforcement structure disposed about the slide body on a first end of the slide body;
b. a second reinforcement structure disposed about the slide body on a second end of the slide body; and
c. a third reinforcement structure disposed about the slide body between the first reinforcement structure and the second reinforcement structure.

4. The top drive track and slide assembly of claim 3, wherein the plurality of corner ridges each extend from: one of the reinforcement structures, the top plate, the bottom plate, or combinations thereof, and wherein each corner ridge extends through one of the plurality of holes.

5. The top drive track and slide assembly of claim 1, wherein:
a. the first extension further comprises a first recess;
b. the fourth insert further comprises a first ridge engaged within the first recess;
c. the second extension further comprises a second recess; and
d. the fifth insert further comprises a second ridge engaged within the second recess.

6. The top drive track and slide assembly of claim 5, wherein each insert fastener is engaged through the first extension and the second extension to attach the fourth insert to the first extension and the fifth insert to the second extension, wherein the fourth insert and the fifth insert each have fastener holes for receiving the insert fasteners, and wherein the insert fasteners extend into fourth insert and the fifth insert without extending past the first ridge and the second ridge.

7. The top drive track and slide assembly of claim 1, wherein:
a. at least a portion of the interlocking tabs on the second insert have widths smaller than the other interlocking tabs on the second insert providing interlocking spaces for the plurality of corner ridges to engage between the interlocking tabs on the fourth insert; and
b. at least a portion of the interlocking tabs on the third insert have widths smaller than the other interlocking tabs on the third insert providing interlocking spaces for the plurality of corner ridges to engage between the interlocking tabs on the fifth insert.

8. A top drive track and slide assembly for use in drilling wells comprising:
a. a torque track slide assembly configured to connect to a top drive housing of a top drive, wherein the torque track slide assembly comprises:
(i) a slide body comprising:
1. a first side wall, a second side wall, and a back wall connected between the first side wall and the second side wall;
2. a first extension connected to the first side wall and disposed parallel to the back wall;
3. a second extension connected to the second side wall and disposed parallel to the back wall; and
4. an opening formed axially between the first extension and the second extension, wherein the modular torque track assembly is configured to be engaged within the opening, and wherein the torque track slide assembly is configured to slide along the modular torque track assembly;
(ii) a top plate and a bottom plate connected to the slide body for reacting torque applied to the slide body and securing the slide body to the top drive housing;
1. a plurality of corner ridges extending axially along:
2. a connection of the first side wall and the back wall;
3. a connection of the second side wall and the back wall;
4. a connection between first side wall and the first extension; and
5. a connection between the second side wall and the second extension, wherein each corner ridge extends within the slide body towards the opening;
(iii) a first insert on the back wall interlocking a second insert on the first side wall and interlocking a third insert on the second side wall, wherein the first insert is interlocked with the plurality of corner ridges that extend axially along the connection of the first side wall and the back wall and with the plurality of corner ridges that extend axially along the connection of the second side wall and the back wall;
(iv) a fourth insert on the first extension interlocking with the second insert, wherein the fourth insert is interlocked with the plurality of corner ridges that extend axially along the connection of the first side wall and the first extension;
(v) a fifth insert on the second extension interlocking with the third insert, wherein the fifth insert is interlocked with the plurality of corner ridges that extend axially along the connection of the second side wall and the second extension, wherein each insert comprises a plurality of interlocking tabs interlocked with a plurality of interlocking spaces of adjacent inserts, and wherein each insert comprises: polyamide, a polymer configured to be non-deforming in the presence of torque, or a polytetrafluoroethylene polymer; and
(vi) a plurality of insert fasteners engaging through the first extension and the second extension securing the fourth insert and the fifth insert to the slide body; and
b. a modular torque track assembly configured to slidably engage the torque track slide assembly, and configured to connect on a drilling rig between a crown of a derrick and a bottom portion of the drilling rig, wherein the modular torque track assembly comprises:
(i) a top track comprising:
(a) a top track pin end comprising top track connecting pins, wherein each top track connecting pin comprises:
a. a top track slot; and
b. a top track angled slot surface formed in each top track slot;
(b) a suspension and alignment end comprising:
1. a top track plate; and
2. a plurality of vertical suspension means affixed to the top track plate; and
(c) a top track body between the top track pin end and the suspension and alignment end;
(ii) a middle track comprising:
(a) a middle track pin end comprising middle track connecting pins, wherein each middle track connecting pin comprises:

a. a middle track slot in each middle track connecting pin; and b. a middle track angled slot surface formed in each middle track slot; and (b) a middle track locking end comprising:

1. a middle track locking device housing non-removably secured to a middle track body between the middle track pin end and the middle track locking end; and 2. middle track pin holes in the middle track locking device housing configured to receive the top track connecting pins, or configured to receive middle track connecting pins from an adjacent middle track;

(iii) a bottom track comprising a bottom track body between a bottom track locking end and a bottom end, wherein the bottom track locking end comprises:

1. a bottom track locking device housing non-removably secured to the bottom track body; and 2. bottom track pin holes in the bottom track locking device housing configured to receive the middle track connecting pins, or configured to receive the top track connecting pins; and (iv) a plurality of locking devices, wherein each locking device housing has one of the plurality of locking devices installed therein for locking adjacent tracks together, and wherein each locking device comprises:

(a) a threaded turnbuckle housing with hex ends comprising:

1. a first threaded locking lug comprising:

a. a first threaded end;

b. a first non-threaded end with an upper non-angled face; and c. a first non-threaded end with a lower angled face or a flat face; and 2. a second threaded locking lug mounted opposite the first threaded locking lug, wherein the second threaded locking lug comprises:

a. a second threaded end;

b. a second non-threaded end with an upper non-angled face; and c. a second non-threaded end with a lower angled face or a flat face;

(b) a retaining cap disposed around the threaded turnbuckle housing with hex ends; and (c) at least one fastener securing the retaining cap and the threaded turnbuckle housing with hex ends to the locking device housing, wherein the threaded turnbuckle housing with hex ends is rotatable to extend the each threaded locking lug, thereby wedging each lower angled face and each upper non-angled face between each angled slot surface and each upper flat surface, and axially pulling and locking together two adjacent tracks of the modular torque track assembly.

9. The top drive track and slide assembly of claim 8, further comprising a plurality of holes disposed:

c. through the back wall and the first side wall at the connection of the back wall and the first side wall;

d. through the back wall and the second side wall at the connection of the back wall and the second side wall;

e. through the first side wall and the first extension at the connection of the first side wall and the first extension; and f. through the second side wall and the second extension at the connection of the second side wall and the second extension.

10. The top drive track and slide assembly of claim 9, further comprising:

g. a first reinforcement structure disposed about the slide body on a first end of the slide body;

h. a second reinforcement structure disposed about the slide body on a second end of the slide body; and i. a third reinforcement structure disposed about the slide body between the first reinforcement structure and the second reinforcement structure.

11. A top drive track for use on a drilling rig, wherein the top drive track comprises a plurality of tracks, and wherein at least two of the tracks connect to one another by a connection, wherein the connection comprises:

a. a pair of track pins extending from one of the tracks, wherein each of the track pins have a slot formed therethrough, and wherein each slot has an angled upper surface;

b. a pair of track pin holes configured to receive the pins at least partially therein formed on the other track, wherein each track pin hole has a side opening that is at least partially aligned with the slot of the track pin at least partially disposed therein; and c. a locking device located between the pair of track pin holes, wherein the locking device is configured to extend a first threaded locking lug through the opening of one of the track pin holes and into engagement of the slot of the track pin located therein, and to extend a second threaded locking lug through the opening of the other track pin hole and into engagement of the slot of the track pin located therein, and wherein each threaded locking lug has a flat upper surface and an angled lower surface.

* * * * *